US010160221B2

(12) United States Patent
Tomoguchi

(10) Patent No.: US 10,160,221 B2
(45) Date of Patent: Dec. 25, 2018

(54) LIQUID CARTRIDGE HAVING ENGAGING SURFACE, AND LIQUID-CONSUMING DEVICE USING THE SAME

(71) Applicant: BROTHER KOGYO KABUSHIKI KAISHA, Nagoya-shi, Aichi-ken (JP)

(72) Inventor: Suguru Tomoguchi, Okazaki (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 15/473,735

(22) Filed: Mar. 30, 2017

(65) Prior Publication Data

US 2018/0093483 A1 Apr. 5, 2018

(30) Foreign Application Priority Data

Sep. 30, 2016 (JP) ..... 2016-192603

(51) Int. Cl.
*B41J 2/175* (2006.01)

(52) U.S. Cl.
CPC ..... *B41J 2/17526* (2013.01); *B41J 2/175* (2013.01); *B41J 2/1752* (2013.01); *B41J 2/17503* (2013.01); *B41J 2/17513* (2013.01); *B41J 2/17566* (2013.01); *B41J 2002/17573* (2013.01)

(58) Field of Classification Search
None
See application file for complete search history.

(56) References Cited

U.S. PATENT DOCUMENTS 5,949,459 A 9/1999 Gasvoda et al.
6,997,548 B2 * 2/2006 Matsuo ..... B41J 2/17513 347/49
9,427,973 B1 8/2016 Promfret
(Continued)

FOREIGN PATENT DOCUMENTS

CN 204605193 U 9/2015
EP 2 803 488 A2 11/2014
(Continued)

OTHER PUBLICATIONS

Extended European Search Report, EP Application No. 17163937.0, dated Oct. 4, 2017.

*Primary Examiner* — Erica Lin
(74) *Attorney, Agent, or Firm* — Merchant & Gould P.C.

(57) ABSTRACT

A liquid cartridge includes: a front surface facing frontward, a rear surface spaced apart from the front surface, an upper surface facing upward and is disposed between the front surface and the rear surface, a liquid supply portion provided at the front surface, a detection portion, an electrical interface disposed at the upper surface, and an engaging surface. The detection portion includes a light-receiving portion configured to receive incident light thereon. The light-receiving portion is positioned upward relative to the upper surface and configured to change a state of the light depending on a state of the liquid cartridge. The engaging surface faces rearward and configured to be engaged with an external member such that the engagement between the engaging surface and the external member restricts the liquid cartridge from moving rearward. The electrical interface and the engaging surface are positioned frontward relative to the light-receiving portion.

17 Claims, 13 Drawing Sheets

(56) References Cited

U.S. PATENT DOCUMENTS

| | | | | |
|---|---|---|---|---|
| 2004/0263572 | A1* | 12/2004 | Naka | B41J 2/17546 347/50 |
| 2010/0265305 | A1* | 10/2010 | Qin | B41J 2/17566 347/86 |
| 2015/0283817 | A1 | 10/2015 | Kanbe et al. | |
| 2016/0279958 | A1 | 9/2016 | Wang et al. | |

FOREIGN PATENT DOCUMENTS

| | | | |
|---|---|---|---|
| JP | 2002-508720 | A | 3/2002 |
| JP | 2013-049165 | A | 3/2013 |
| JP | 3197783 | | 5/2015 |

* cited by examiner

LIQUID CARTRIDGE HAVING ENGAGING SURFACE, AND LIQUID-CONSUMING DEVICE USING THE SAME

CROSS REFERENCE TO RELATED APPLICATION

This application claims priority from Japanese Patent Application No. 2016-192603 filed Sep. 30, 2016. The entire content of the priority application is incorporated herein by reference.

TECHNICAL FIELD

The present disclosure relates to a liquid cartridge storing liquid therein and a liquid-consuming device to which the liquid cartridge is attachable.

BACKGROUND

Conventionally, there has been known an inkjet recording apparatus configured to print images on recording mediums by ejecting ink stored in an ink cartridge through nozzles. Whenever ink stored in an ink cartridge runs out, a new ink cartridge is detachably mounted in such inkjet recording apparatus.

For example, Japanese Patent Application Publication No. 2002-508720 discloses an ink container that is attachable to and detachable from a printer. During attachment of the ink container to the printer, a liquid outlet and an air inlet of the ink container are configured to fit into a liquid inlet and an air outlet of the printer, respectively, thereby enabling the ink container to be pivotally movable about fitted parts. Due to pivotal movement of the ink container, an engaging mechanism of the ink container is engaged with an engagement mechanism of the printer. As a result, the ink container is fixed in position relative to the printer against biasing forces of springs provided in the printer.

SUMMARY

In the ink container disclosed in Japanese Patent Application Publication No. 2002-508720, the engaging mechanism is provided in a rear portion of the ink container, while the liquid outlet and the air inlet are provided in a front portion of the ink container. That is, the engaging mechanism is positioned away from the pivot center (i.e., the liquid outlet and the air inlet) of the ink container in a front-rear direction. Accordingly, when the ink container is pivotally moved, the engaging mechanism is moved significantly in an up-down direction. As a result, the engaging mechanism of the ink container is easily engaged with or disengaged from the engagement mechanism of the printer.

However, when the engaging mechanism of the ink container is moved significantly in the up-down direction in association with the pivotal movement of the ink container as described above, the position of the engaging mechanism of the ink container may deviate largely while the ink container remains attached to the printer. That is, while the ink container remains attached to the printer, the posture of the ink container will be unstable. This may lead to deteriorations in detection accuracy for detecting a state of the ink container (for example, amount of ink stored in the ink container) by using a sensor.

In view of the foregoing, it is an object of the present disclosure to provide a liquid cartridge capable of maintaining a stable posture while the liquid cartridge remains attached to an image recording apparatus.

In order to attain the above and other objects, the present disclosure provides a liquid cartridge configured to store liquid therein. The liquid cartridge includes a front surface, a rear surface, an upper surface, a liquid supply portion, a detection portion, an electrical interface, and an engaging surface. The front surface faces frontward. The rear surface is spaced apart from the front surface. The upper surface is disposed between the front surface and the rear surface. The upper surface faces upward. The liquid supply portion is provided at the front surface and configured to supply the liquid to outside of the liquid cartridge. The detection portion includes a light-receiving portion configured to receive incident light thereon. The light-receiving portion is positioned upward relative to the upper surface. The detection portion is configured to change a state of the incident light depending on a state of the liquid cartridge. The electrical interface is disposed at the upper surface. The electrical interface is positioned frontward relative to the light-receiving portion. The engaging surface faces rearward and configured to be engaged with an external member such that the engagement between the engaging surface and the external member restricts the liquid cartridge from moving rearward. The engaging surface is positioned frontward relative to the light-receiving portion.

According to another aspect, the disclosure provides a liquid-consuming device including a liquid cartridge, a cartridge-attachment section, and a consuming section. The liquid cartridge is configured to store liquid therein. The liquid cartridge includes a front surface, a rear surface, an upper surface, a liquid supply portion, a detection portion, an electrical interface, and an engaging surface. The front surface faces frontward. The rear surface is spaced apart from the front surface. The upper surface is disposed between the front surface and the rear surface. The upper surface faces upward. The liquid supply portion is provided at the front surface and configured to supply the liquid to outside of the liquid cartridge. The detection portion includes a light-receiving portion configured to receive incident light thereon. The light-receiving portion is positioned upward relative to the upper surface. The detection portion is configured to change a state of the incident light depending on a state of the liquid cartridge. The electrical interface is disposed at the upper surface. The electrical interface is positioned frontward relative to the light-receiving portion. The electrical interface includes an electrode. The engaging surface faces rearward and configured to be engaged with an external member such that the engagement between the engaging surface and the external member restricts the liquid cartridge from moving rearward. The engaging surface is positioned frontward relative to the light-receiving portion. The liquid cartridge is movable in a frontward direction so as to be attached to the cartridge-attachment section and movable in a rearward direction so as to be detached from the cartridge-attachment section. The liquid cartridge attached to the cartridge-attachment section being in an attached state. The cartridge-attachment section includes a contact, a sensor, and an engaged surface. The contact is configured to be electrically connected to the electrode of the electrical interface of the liquid cartridge attached to the cartridge-attachment section. The sensor includes a light-emitting element and a light-receiving element positioned opposite to each other. The light-receiving portion of the liquid cartridge attached to the cartridge-attachment section is configured to be interposed between the light-emitting element and the light-receiving element.

The engaged surface is configured to be engaged with the engaging surface of the liquid cartridge attached to the cartridge-attachment section such that the engagement between the engaging surface of the liquid cartridge and the engaged surface restricts the liquid cartridge attached to the cartridge-attachment section from moving rearward. The consuming section is configured to consume the liquid stored in the liquid cartridge attached to the cartridge-attachment section.

BRIEF DESCRIPTION OF THE DRAWINGS

The particular features and advantages of the disclosure will become apparent from the following description taken in connection with the accompanying drawings, in which.

DETAILED DESCRIPTION

Figure 1:
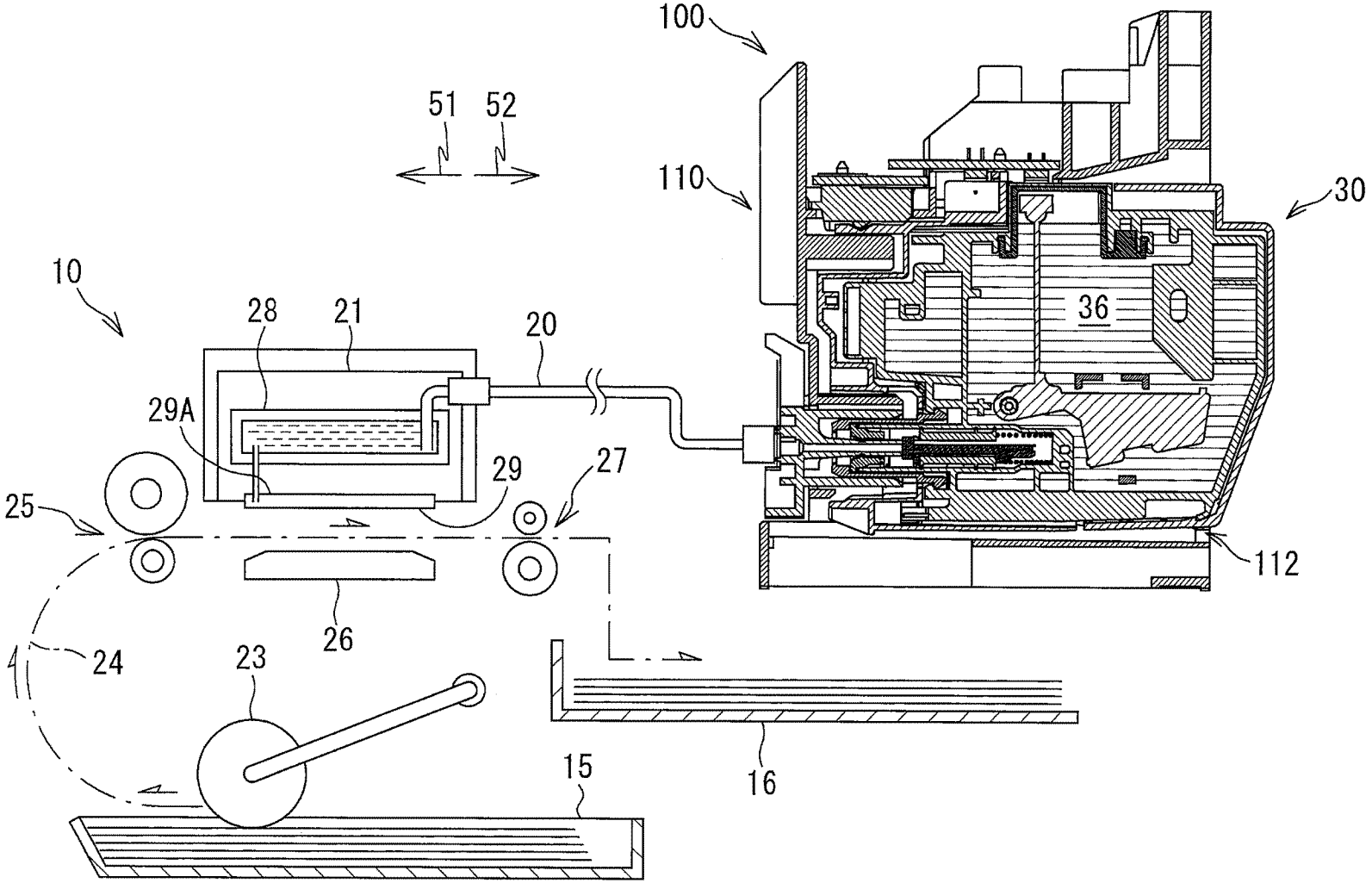
FIG. 1 is a schematic cross-sectional diagram conceptually showing an internal configuration of a printer provided with a cartridge-attachment section configured to detachably accommodate an ink cartridge according to an embodiment of the present disclosure.

Hereinafter, one embodiment of the disclosure will be described in detail while referring to accompanying drawings. It would be apparent to those skilled in the art that the embodiment described below is merely an example of the present disclosure and modifications and variations may be made therein without departing from the scope of the disclosure.

In the following description, a frontward direction 51 is defined as a direction in which an ink cartridge 30 according to the embodiment is inserted into a cartridge-attachment section 110, while a rearward direction 52 is defined as a direction opposite the frontward direction 51, that is, a direction in which the ink cartridge 30 is extracted from the cartridge-attachment section 110. While the frontward direction 51 and rearward direction 52 are parallel to the horizontal direction in the present embodiment, the frontward direction 51 and rearward direction 52 need not be parallel to the horizontal direction.

Further, a downward direction 53 is defined as a direction coincident with a gravitational direction, while an upward direction 54 is defined as a direction opposite the downward direction 53. Further, a rightward direction 55 and a leftward direction 56 are defined as directions perpendicular to the frontward direction 51 and the downward direction 53. More specifically, in a state where the ink cartridge 30 has been received in the cartridge-attachment section 110, i.e., in a state where the ink cartridge 30 is in an attached posture (an attached state of the ink cartridge 30), and when a user views the ink cartridge 30 from its front side, the rightward direction 55 is a direction toward the right and the leftward direction 56 is a direction toward the left.

Further, in the following description, the frontward direction 51 and the rearward direction 52 may be collectively referred to as a front-rear direction 51 and 52 (an example of a horizontal direction). The upward direction 54 and the downward direction 53 may be collectively referred to as an up-down direction 53 and 54 (an example of a vertical direction). The rightward direction 55 and the leftward direction 56 may be collectively referred to as a right-left direction 55 and 56 (an example of a widthwise direction).

In this specification, "facing frontward" includes facing in a direction including a frontward component, "facing rearward" includes facing in a direction including a rearward component, "facing downward" includes facing in a direction including a downward component, and "facing upward" includes facing in a direction including an upward component. For example, "a front surface faces frontward" denotes that the front surface may face in a frontward direction, or the front surface may face in a direction inclined relative to the frontward direction.

<Overview of Printer 10>

First, a printer 10 adapted to receive the ink cartridge 30 according to the embodiment will be described with reference to FIG. 1.

The printer 10 (an example of a liquid-consuming device) is configured to form an image by selectively ejecting ink droplets onto a sheet based on an inkjet recording system. As shown in FIG. 1, the printer 10 includes a recording head 21 (an example of a consuming section), an ink-supplying device 100, and an ink tube 20 connecting the recording head 21 to the ink-supplying device 100. The ink-supplying device 100 includes the cartridge-attachment section 110 (an example of an external member). The cartridge-attachment section 110 can detachably accommodate the ink cartridge 30 (an example of a liquid cartridge) therein.

The cartridge-attachment section 110 has a surface formed with an opening 112. The ink cartridge 30 can be inserted into the cartridge-attachment section 110 in the frontward direction 51 through the opening 112, and extracted from the cartridge-attachment section 110 in the rearward direction 52 through the opening 112.

The ink cartridge 30 stores ink therein that the printer 10 can use for printing. The ink cartridge 30 is connected to the recording head 21 through the ink tube 20 when the ink cartridge 30 has been completely mounted in the cartridge-attachment section 110.

The recording head 21 includes a sub tank 28 for temporarily storing ink supplied from the ink cartridge 30 through the ink tube 20. The recording head 21 also includes a plurality of nozzles 29 through which the ink supplied from the sub tank 28 is selectively ejected in accordance with the inkjet recording system. More specifically, the recording head 21 includes a head control board (not shown), and piezoelectric elements 29A each corresponding to one of the nozzles 29. The head control board is configured to selectively apply drive voltages to the piezoelectric elements 29A to eject ink selectively from the nozzles 29. In this way, the recording head 21 is configured to consume the ink stored in the ink cartridge 30 that has been completely mounted in the cartridge-attachment section 110.

The printer 10 also includes a sheet tray 15, a sheet feeding roller 23, a conveying path 24, a pair of conveying rollers 25, a platen 26, a pair of discharge rollers 27, and a sheet discharge tray 16. The sheets from the sheet tray 15 are fed by the sheet feeding roller 23 onto the conveying path 24, and then conveyed by the conveying rollers 25 onto the platen 26. The recording head 21 is configured to selectively eject ink onto the sheets as the sheets move over the platen 26, thereby recording images on the sheets. The sheets that have passed the platen 26 are then discharged by the discharge rollers 27 onto the sheet discharge tray 16 disposed at a downstream end of the conveying path 24.

<Ink-Supplying Device 100>

The ink-supplying device 100 is provided in the printer 10, as shown in FIG. 1. The ink-supplying device 100 functions to supply ink to the recording head 21. As described above, the ink-supplying device 100 includes the cartridge-attachment section 110 for detachably receive the ink cartridge 30 therein. FIG. 1 shows a state where the ink cartridge 30 has been completely received in the cartridge-attachment section 110. In other words, the ink cartridge 30 is in the attached state in FIG. 1.

<Cartridge-Attachment Section 110>

Figure 2:
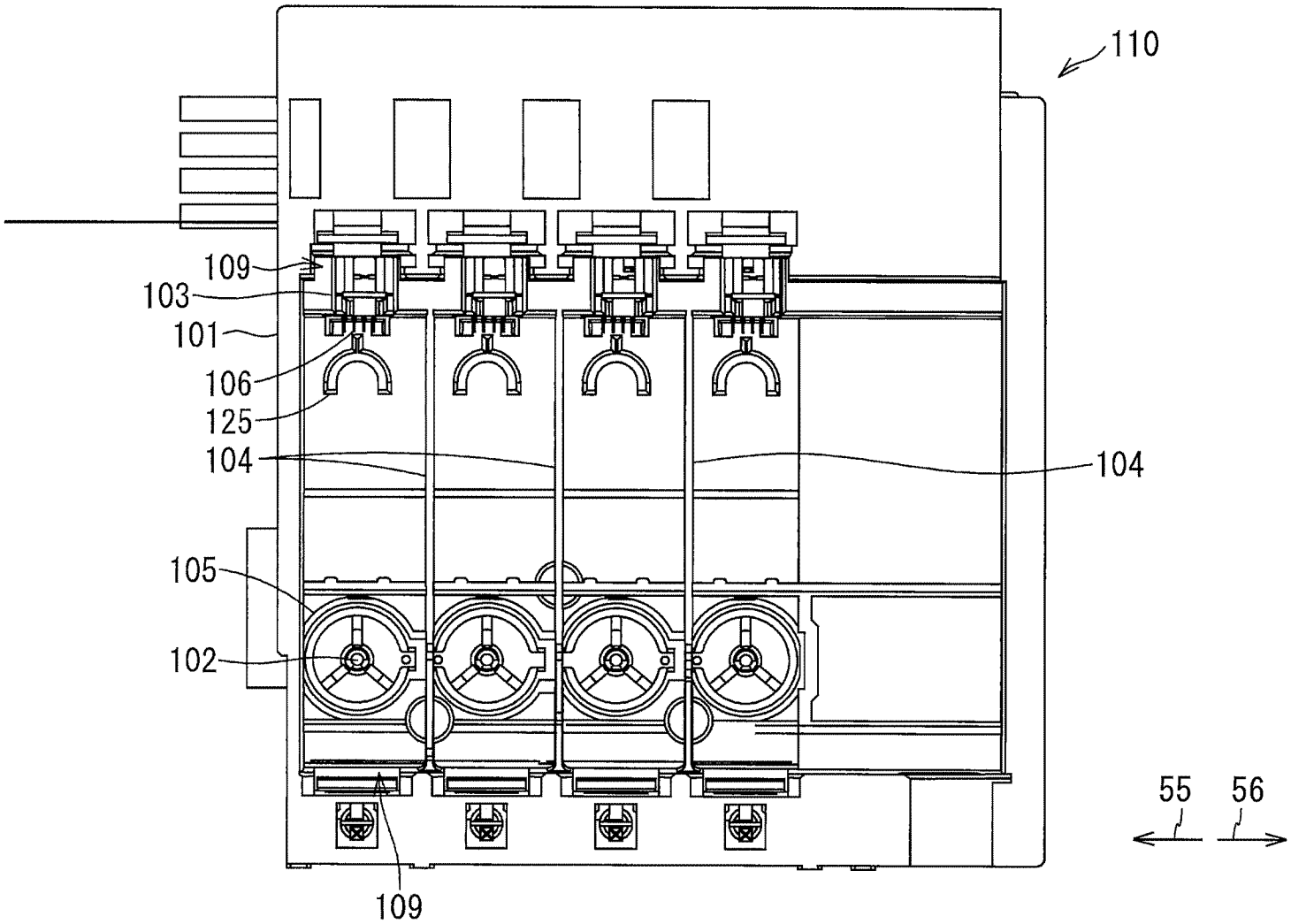
FIG. 2 is a view showing an external appearance of the cartridge-attachment section.
Figure 7:
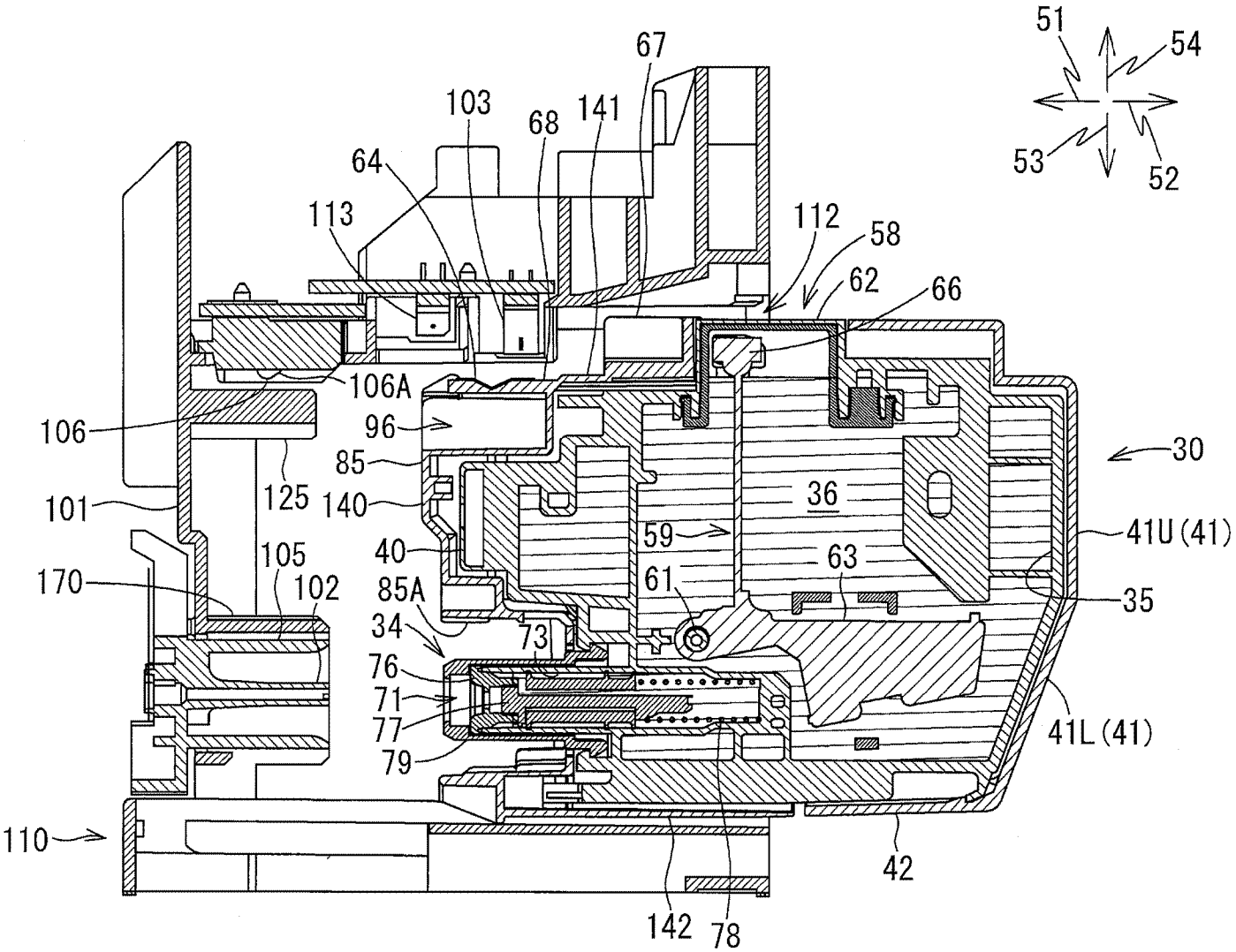
FIG. 7 is a vertical cross-sectional view illustrating the ink cartridge according to the embodiment and the cartridge-attachment section, and illustrating a state where the ink cartridge is started to be inserted into the cartridge-attachment section.

As illustrated in FIGS. 2 and 7, the cartridge-attachment section 110 includes a case 101, ink needles 102, residual-amount sensors 103, attachment sensors 113, and contacts 106. In the cartridge-attachment section 110, four kinds of ink cartridges 30 corresponding to four colors of cyan, magenta, yellow and black are detachably mountable. One ink needle 102, one residual-amount sensor 103, one attachment sensor 113, and four contacts 106 are provided corresponding to each of the four kinds of ink cartridges 30.

<Case 101>

The case 101 constitutes a casing of the cartridge-attachment section 110. The case 101 has a box-like shape defining an internal space therein. Specifically, the case 101 includes a top wall defining a top part of the internal space, a bottom wall defining a bottom of the internal space, an end wall connecting the top wall and the bottom wall, and the opening 112 positioned opposite the end wall in the front-rear direction 51 and 52. The opening 112 can be exposed to a surface (user-interface surface) that a user can face when using the printer 10.

The four kinds of ink cartridges 30 can be inserted into and removed from the case 101 through the opening 112. In the case 101, each of the top wall and the bottom wall is formed with four guide grooves 109 for guiding insertion/removal of the ink cartridges 30. Specifically, when the ink cartridge 30 is inserted into and removed from the case 101 through the opening 112, upper and lower ends of the ink cartridge 30 are received in the corresponding upper and lower guide grooves 109 and guided thereby in the front-rear direction 51 and 52, as shown in FIG. 7. Further, the case 101 also includes three plates 104 that partition the internal space into four individual spaces each elongated in the up-down direction 53 and 54. Each of the four kinds of ink cartridges 30 can be mounted in a corresponding one of the four spaces defined by the plates 104.

Hereinafter, for simplifying explanation, only one ink cartridge 30 is assumed to be mounted in the case 101 of the cartridge-receiving section 110.

<Ink Needle 102>

The ink needle 102 (an example of a tube) is formed of a resin and has a generally tubular shape. As shown in FIG. 7, the ink needle 102 is disposed on a lower end portion of the end wall constituting the case 101. Specifically, the ink needle 102 is disposed at a position corresponding to an ink supply potion 34 (described later) of the ink cartridge 30 mounted in the cartridge-attachment section 110. The ink needle 102 protrudes rearward from the end wall of the case 101.

A cylindrical-shaped guide portion 105 is provided on the end wall to surround the ink needle 102. The guide portion 105 protrudes rearward from the end wall. The guide portion 105 has a protruding end that is open rearward. Specifically, the ink needle 102 is positioned at a diametrical center of the guide portion 105. The guide portion 105 is shaped to allow the ink supply potion 34 of the mounted ink cartridge 30 to be received in the guide portion 105.

Figure 8:
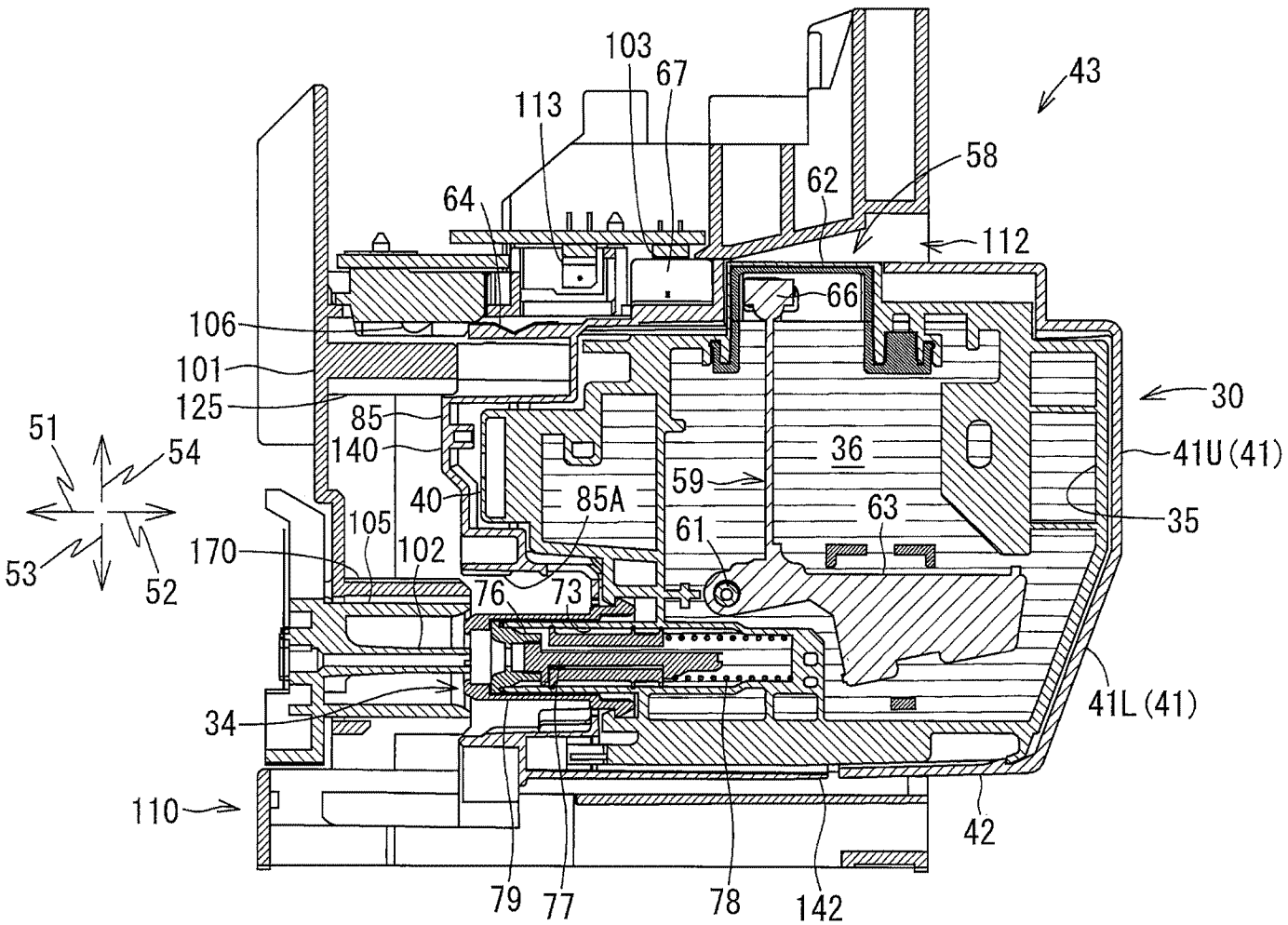
FIG. 8 is a vertical cross-sectional view illustrating the ink cartridge according to the embodiment and the cartridge-attachment section, and illustrating a state where; an ink supply portion of the ink cartridge starts entering into a guide portion of the cartridge-attachment section; and a rod of the cartridge-attachment section starts entering into a recess of the ink cartridge.

During insertion of the ink cartridge 30 into the cartridge-attachment section 110 in the frontward direction 51, i.e., in the course of action for bringing the ink cartridge 30 into a mounted position mounted in the cartridge-attachment section 110, the ink supply potion 34 of the ink cartridge 30 enters into the guide portion 105 (see FIG. 8). As the ink cartridge 30 is further inserted forward, the ink needle 102 enters into an ink supply port 71 of the ink supply potion 34 (see FIG. 9). The ink needle 102 is thus connected to the ink supply potion 34 to allow communication with each other.

Hence, the ink stored in an ink chamber 36 formed in the ink cartridge 30 is allowed to flow into the ink tube 20 connected to the ink needle 102 through an internal space defined in the ink supply potion 34 and an inner space defined in the ink needle 102. Incidentally, the ink needle 102 may have a flat-shaped tip end or a pointed tip end.

<Contacts 106>

Figure 9:
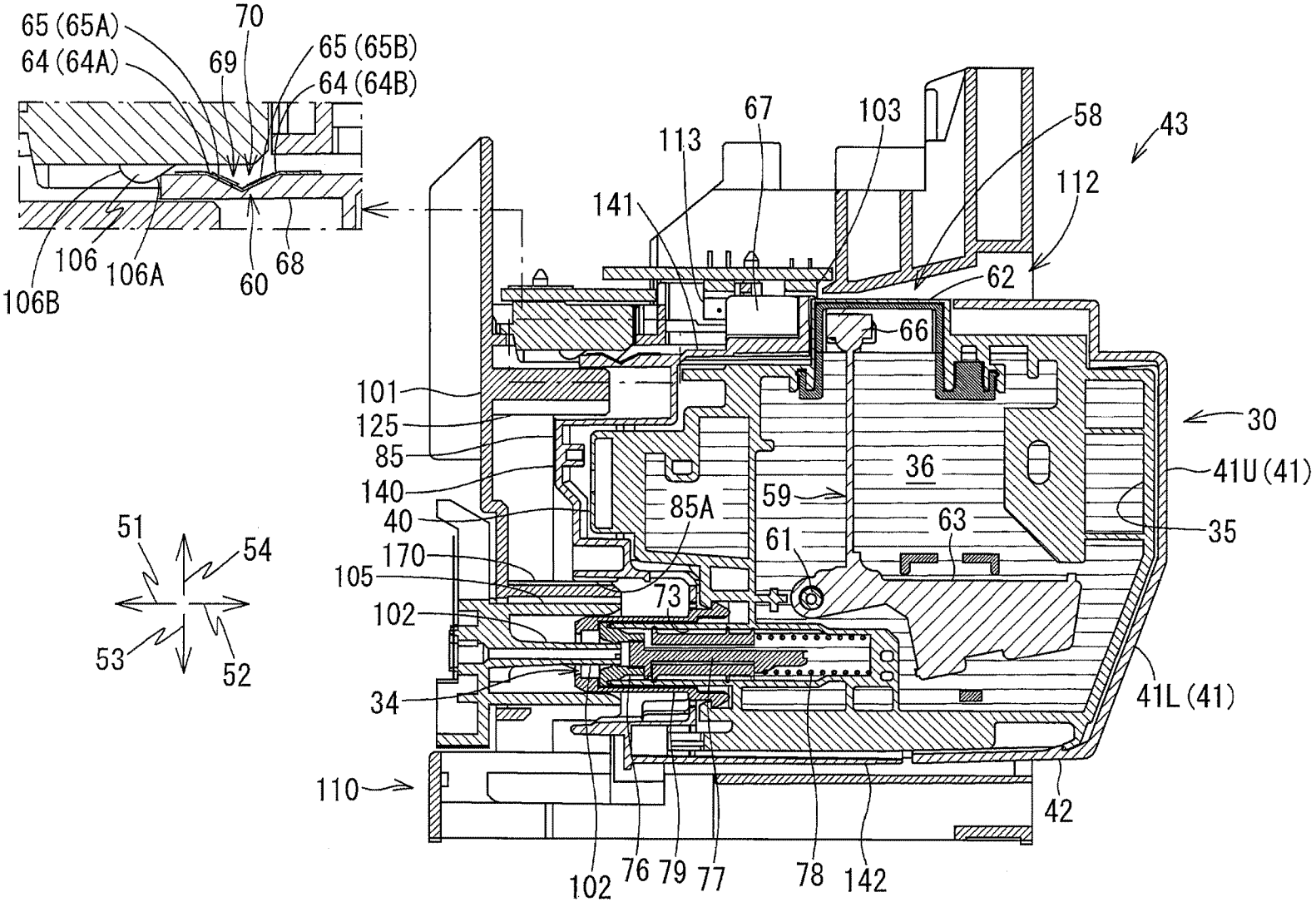
FIG. 9 is a vertical cross-sectional view illustrating the ink cartridge according to the embodiment and the cartridge-attachment section, and illustrating a state where; an ink needle of the cartridge-attachment section starts entering into an ink supply port of the ink supply portion; and a support base of the ink cartridge contacts a contact of the cartridge-attachment section from its rear side.
Figure 11:
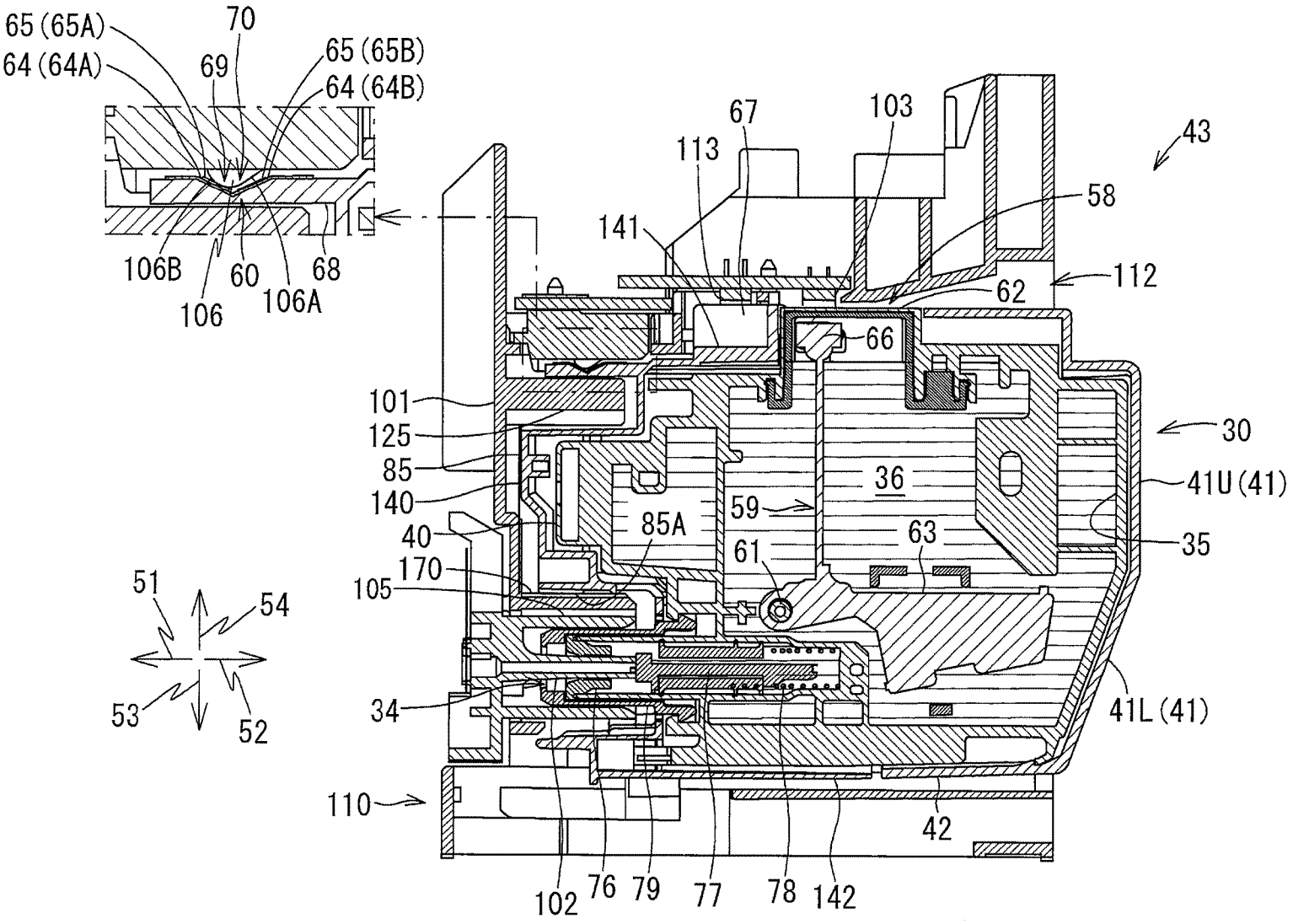
FIG. 11 is a vertical cross-sectional view illustrating the ink cartridge according to the embodiment and the cartridge-attachment section, and illustrating a state where; the ink needle is in the ink supply port of the ink supply portion; and the ink cartridge is fixed in position relative to the cartridge-attachment section.

As shown in FIGS. 2 and 7, four contacts 106 are disposed on the top wall of the case 101 at positions near the end wall of the case 101. That is, the four contacts 106 are provided at a front end portion of an upper part constituting the cartridge-attachment section 110. As shown in FIG. 9, each contact 106 is curved downward and includes a surface 106A and a surface 106B (an example of an engaged surface). The surface 106A faces rearward and downward. The surface 106B is positioned frontward of the surface 106A, and faces frontward and downward. As shown in FIG. 11, each of the surfaces 106B is engaged with a corresponding surface (an example of an engaging surface) of an electrode 65A formed on a surface 64A of an IC board 64 (described later) of the ink cartridge 30 in a state where the ink cartridge 30 is attached to the cartridge-attachment section 110. As described above, the surfaces 106A and 106B face downward. That is, the surfaces 106A and 106B face the internal space of the cartridge-attachment section 110 in which the ink cartridge 30 is accommodated.

Although not illustrated in detail in the drawings, the four contacts 106 are arranged to be spaced apart from one another in the right-left direction 55 and 56. Each of the four contacts 106 is arranged at a position corresponding to each one of four electrodes 65 of the ink cartridge 30 as will be described later (see FIGS. 3A and 4A). Each contact 106 is formed of a material having electrical conductivity and resiliency. The contacts 106 are therefore upwardly resiliently deformable.

Note that, in the present embodiment, four sets of the four contacts 106 are disposed corresponding to the four ink cartridges 30 that can be mounted in the case 101. However, the number of contacts 106 and the number of electrodes 65 may be arbitrary.

Each contact 106 is electrically connected to an arithmetic-logic unit (not shown) via an electrical circuit. The arithmetic-logic unit may include a CPU, a ROM, and a RAM, for example, or may be configured as a controller of the printer 10. When the respective contacts 106 are electrically connected to the corresponding electrodes 65, so that: a voltage Vc is applied to the corresponding electrode 65; the corresponding electrode 65 is grounded; and power is supplied to the corresponding electrode 65. Due to establishment of the electrical connection between the contacts 106 and the electrodes 65, the data stored in an IC of the ink cartridge 30 is made electrically accessible. Outputs from the electrical circuits are configured to be inputted into the arithmetic-logic unit.

As will be described later, in the present embodiment, the electrodes 65A which is a part of the four electrodes 65 are formed on the surface 64A of the IC board 64 (see FIG. 6). In the state where the ink cartridge 30 is attached to the cartridge-attachment section 110, each surface 106B of each contact 106 of the cartridge-attachment section 110 is engaged with the corresponding surface of the electrode 65A formed on the surface 64A, as shown in FIG. 11. As a result, each contact 106 is electrically connected to the corresponding electrode 65A.

<Rod 125>

As shown in FIGS. 2 and 7, a rod 125 is provided at the end wall of the case 101 at a position above the ink needle 102. The rod 125 protrudes rearward from the end wall of the case 101. The rod 125 is shaped like an upper half portion of a cylinder. That is, the rod 125 has an inverted U-shape in cross-section taken along a plane perpendicular to the front-rear direction 51 and 52. The rod 125 has a rib that protrudes upward from an uppermost portion of the inverted U-shape. The rib extends in the front-rear direction 51 and 52. In the state where the ink cartridge 30 is attached to the cartridge-attachment section 110, that is, when the ink cartridge 30 is in the mounted position, the rod 125 is received in a recess 96 (described later) of the mounted ink cartridge 30.

<Residual-Amount Sensor 103>

As shown in FIG. 7, the residual-amount sensor 103 (an example of a sensor) is disposed at the top wall of the case 101 at a position rearward of the contacts 106. The residual-amount sensor 103 includes a light-emitting element and a light-receiving element. The light-emitting element and the light-receiving element are arranged to oppose and to be spaced apart from each other in the right-left direction 55 and 56. When the ink cartridge 30 has been attached to the cartridge-attachment section 110, a housing 62 (described later) of the ink cartridge 30 is disposed between the light-emitting element and the light-receiving element of the residual-amount sensor 103. In other words, the light-emitting element and the light-receiving element are arranged to oppose each other with the housing 62 of the attached ink cartridge 30 interposed therebetween.

The light-emitting element is configured to emit light in the right-left direction 55 and 56, and the light-receiving element is configured to receive the light emitted from the light-emitting element. The residual-amount sensor 103 is configured to output different detection signals depending on whether the light emitted from the light-emitting element is received by the light-receiving element. For example, the residual-amount sensor 103 outputs a low-level signal (a signal whose level is less than a threshold level) when the light emitted from the light-emitting element is not received by the light-receiving element (i.e., when an intensity of the light received at the light-receiving element is less than a predetermined intensity). On the other hand, the residual-amount sensor 103 outputs a high-level signal (a signal whose level is equal to or greater than the threshold level) when the light emitted from the light-emitting element is received by the light-receiving element (i.e., when the intensity of the light received at the light-receiving element is equal to or greater than the predetermined intensity).

<Attachment Sensor 113>

As illustrated in FIG. 7, the attachment sensor 113 is also disposed at the top wall of the case 101. Specifically, the attachment sensor 113 is disposed at a position frontward of the residual-amount sensor 103 but rearward of the contacts 106. The attachment sensor 113 includes a light-emitting element and a light-receiving element. The light-emitting element is arranged to oppose the light-receiving element and is spaced apart from the light-receiving element in the right-left direction 55 and 56. When the ink cartridge 30 has been attached to the cartridge-attachment section 110, a first light-blocking plate 67 of the attached ink cartridge 30 is disposed between the light-emitting element and the light-receiving element of the attachment sensor 113. In other words, the light-emitting element and the light-receiving element are arranged to oppose each other with the first light-blocking plate 67 of the mounted ink cartridge 30 interposed therebetween.

The attachment sensor 113 is configured to output different detection signals depending on whether or not light emitted in the right-left direction 55 and 56 from the light-emitting element is received by the light-receiving element. For example, the attachment sensor 113 outputs a low-level signal when the light emitted from the light-emitting element is not received at the light-receiving element (that is, when an intensity of the light received at the light-receiving element is less than a predetermined intensity). On the other hand, the attachment sensor 113 outputs a high-level signal when the light emitted from the light-emitting element is received by the light-receiving element (that is, when the intensity of the received light is equal to or greater than the predetermined intensity).

<Ink Cartridge 30>

The ink cartridge 30 shown in FIGS. 3A to 6 is a container configured to store ink therein. The ink cartridge 30 defines an inner space therein serving as the ink chamber 36 configured to store ink (see FIG. 1). The ink chamber 36 may be formed in any appropriate manner. For example, in this embodiment, the ink chamber 36 is formed by an inner frame 35. The inner frame 35 is a frame accommodated in a rear cover 31 and a front cover 32. That is, the rear cover 31 and front cover 32 constitute an outer shell of the ink cartridge 30.

The posture of the ink cartridge 30 shown in FIGS. 3A to 6 is a posture when the ink cartridge 30 is in the attached state. As will be described later, the ink cartridge 30 includes a front wall 140, a rear wall 41, top walls 39 and 141, and bottom walls 42 and 142. When the ink cartridge 30 is in the posture shown in FIGS. 3A to 6 (i.e., in the attached state), a direction from the rear wall 41 toward the front wall 140 coincides with the frontward direction 51; a direction from the front wall 140 toward the rear wall 41 coincides with the rearward direction 52; a direction from the top walls 39 and 141 toward the bottom walls 42 and 142 coincides with the downward direction 53, and a direction from the bottom walls 42 and 142 toward the top walls 39 and 141 coincides with the upward direction 54.

The rear wall 41 is positioned rearward of and away from the front wall 140. The top walls 39 and 141 are positioned between the front wall 140 and the rear wall 41. The bottom walls 42 and 142 are positioned below and away from the top walls 39 and 141, respectively. The bottom walls 42 and 142 are positioned between the front wall 140 and the rear wall 41.

When the ink cartridge 30 is attached to the cartridge-attachment section 110, the front wall 140 faces frontward, the rear wall 41 faces rearward, the bottom walls 42 and 142 face downward, and the top walls 39 and 141 face upward. More specifically, in the attached state of the ink cartridge 30, a front surface of the front wall 140 faces frontward, a rear surface of the rear wall 41 faces rearward, bottom surfaces of the bottom walls 42 and 142 face downward, and top surfaces of the top walls 39 and 141 face upward.

As illustrated in FIGS. 3A to 6, the ink cartridge 30 includes the rear cover 31, the front cover 32, and the inner frame 35 defining the ink chamber 36. The rear cover 31 has a substantially rectangular parallelepiped shape. The front cover 32 has a substantially rectangular parallelepiped shape. The rear cover 31 includes the rear wall 41. The front cover 32 includes the front wall 140. The front cover 32 is assembled to the rear cover 31 to form the outer shell of the ink cartridge 30. The inner frame 35 is accommodated in the rear cover 31 and the front cover 32 assembled to each other.

In the attached state, the ink cartridge 30 extends in the front-rear direction 51 and 52, in the up-down direction 53 and 54, and in the right-left direction 55 and 56. The ink cartridge 30 has a generally flat shape having a height in the up-down direction 53 and 54, a width in the right-left direction 55 and 56, and a length in the front-rear direction 51 and 52, the width being smaller than the height and the length. A surface of the front cover 32 facing in an insertion direction (frontward) when the ink cartridge 30 is inserted into the cartridge-attachment section 110 is the front surface of the front wall 140. A surface of the rear cover 31 facing in a removal direction (rearward) when the ink cartridge 30 is removed from the cartridge-attachment section 110 is the rear surface of the rear wall 41. That is, the rear wall 41 is disposed to oppose the front wall 140 such that the ink chamber 36 is interposed between the front wall 140 and the rear wall 41.

<Rear Cover 31>

As shown in FIGS. 3A to 4B, the rear cover 31 includes the rear wall 41, side walls 37 and 38, the top wall 39, and the bottom wall 42. The side walls 37 and 38 are disposed spaced apart from each other in the right-left direction 55 and 56. The top wall 39 and the bottom wall 42 are disposed spaced apart from each other in the up-down direction 53 and 54. The side walls 37 and 38, the top wall 39 and the bottom wall 42 extend frontward from the rear wall 41. That is, the rear cover 31 has a box-like shape formed with an opening that is open frontward. The inner frame 35 is inserted into the rear cover 31 via this opening. In other words, the rear cover 31 covers a rear portion of the inner frame 35. In a state where the inner frame 35 is inserted in the rear cover 31, the ink chamber 36 is arranged to be interposed between the top wall 39 and the bottom wall 42.

The rear wall 41 includes an upper portion 41U and a lower portion 41L. The upper portion 41U is arranged above the lower portion 41L. The lower portion 41L is positioned frontward relative to the upper portion 41U. The upper portion 41U and the lower portion 41L are both planar shaped, and intersect each other but are not perpendicular to each other. Specifically, the lower portion 41L is inclined relative to the up-down direction 53 and 54 such that the lower portion 41L extends closer to the front wall 140 as extending toward the bottom wall 42. Although not illustrated in the drawings, a sheet prompting a user to push the upper portion 41U is attached to the upper portion 41U. The sheet may include a text such as "PUSH", a sign such as an arrow, or a figure indicating pushing with a finger.

Incidentally, the rear wall 41 may not include the lower portion 41L and may be configured solely of the upper portion 41U. That is, a lower end of the upper portion 41U may be connected to a rear end of the bottom wall 42 of the rear cover 31.

<Front Cover 32>

As illustrated in FIGS. 3A to 4B, the front cover 32 includes the front wall 140, side walls 143 and 144, the top wall 141 and the bottom wall 142. The side walls 143 and 144 are disposed spaced apart from each other in the right-left direction 55 and 56. The top wall 141 and the bottom wall 142 are disposed spaced apart from each other in the up-down direction 53 and 54. The side walls 143 and 144, the top wall 141 and the bottom wall 142 extend rearward from the front wall 140. That is, the front cover 32 has a box shape formed with an opening that is open rearward. The inner frame 35 is inserted into the front cover 32 via the opening. That is, the front cover 32 covers a front portion of the inner frame 35 that is not covered with the rear cover 31.

In a state where the front cover 32 and the rear cover 31 are assembled to each other, that is, in a state where assembly of the ink cartridge 30 is completed, the top wall 141 of the front cover 32 and the top wall 39 of the rear cover 31 constitute a top wall of the ink cartridge 30; the bottom wall 142 of the front cover 32 and the bottom wall 42 of the rear cover 31 constitute a bottom wall of the ink cartridge 30; and the side walls 143 and 144 of the front cover 32 and the side walls 37 and 38 of the rear cover 31 constitute side walls of the ink cartridge 30.

That is, in the assembled ink cartridge 30, a top surface of the top wall 141 and a top surface of the top wall 39 constitute a top surface of the ink cartridge 30; a bottom surface of the bottom wall 142 and a bottom surface of the bottom wall 42 constitute a bottom surface of the ink cartridge 30; and outer surfaces of the side walls 143 and 144 and outer surfaces of the side walls 37 and 38 constitute side surfaces of the ink cartridge 30.

Further, in the state where the ink cartridge 30 is assembled, the front wall 140 of the front cover 32 constitutes a front wall of the ink cartridge 30, whereas the rear wall 41 of the rear cover 31 constitutes a rear wall of the ink cartridge 30. The front wall of the ink cartridge 30 (front wall 140 of the front cover 32) and the rear wall of the ink cartridge 30 (rear wall 41 of the rear cover 31) are arranged spaced apart from each other in the front-rear direction 51 and 52. That is, in the attached posture, the front surface of the front wall 140 constitutes a front surface the ink cartridge 30; and the rear surface of the rear wall 41 constitutes a rear surface of the ink cartridge 30.

Incidentally, the front surface, rear surface, top surface, bottom surface, and side surfaces constituting the ink cartridge 30 need not be configured as one fiat plane, respectively. That is, the front surface of the ink cartridge 30 can be any surface(s) that can be seen when the ink cartridge 30 in its attached posture is viewed from its front side, and that is(are) positioned frontward relative to a center of the ink cartridge 30 in the front-rear direction 51 and 52. The rear surface of the ink cartridge 30 can be any surface(s) that can be seen when the ink cartridge 30 in its attached posture is viewed from its rear side, and that is(are) positioned rearward relative to the center of the ink cartridge 30 in the front-rear direction 51 and 52. The top surface of the ink cartridge 30 can be any surface(s) that can be seen when the ink cartridge 30 in its attached posture is viewed from above, and that is(are) positioned upward relative to a center of the ink cartridge 30 in the up-down direction 53 and 54. The bottom surface of the ink cartridge 30 can be any surface(s) that can be seen when the ink cartridge 30 in its attached posture is viewed from below, and that is(are) positioned downward relative to the center of the ink cartridge 30 in the up-down direction 53 and 54. The same is applied to the side surfaces.

The front wall 140 includes a first protruding portion 85 and a second protruding portion 86. The first protruding portion 85 protrudes frontward from an upper end portion of the front cover 32 to constitute an upper end portion of the front wall 140. The first protruding portion 85 has a front end constituting a part of the front surface of the front wall 140. The second protruding portion 86 protrudes frontward from a lower end portion of the front cover 32 to constitute a lower end portion of the front wall 140. The second protruding portion 86 is positioned below the ink supply portion 34.

The recess 96 is formed in the front end of the first protruding portion 85. That is, the recess 96 is formed in the upper end portion of the front wall 140 of the front cover 32. The recess 96 is recessed rearward relative to the front surface of the front wall 140. The recess 96 is adapted to receive the rod 125 therein when the ink cartridge 30 is attached to the cartridge-attachment section 110. Accordingly, the recess 96 has a cross-sectional shape in conformance with a cross-sectional shape of the rod 125 taken along a plane perpendicular to the front-rear direction 51 and 52.

A through-hole 97 is formed in a lower end portion of the front wall 140 to penetrate the same in the front-rear direction 51 and 52. When the inner frame 35 is inserted in the front cover 32, the ink supply portion 34 provided at the inner frame 35 is exposed outside through the through-hole 97. Accordingly, the through-hole 97 is formed at a position, with a size and a shape corresponding to those of the ink supply portion 34 of the inner frame 35.

Further, a through-hole 98 is formed in the top wall 141 of the front cover 32. The through-hole 98 penetrates the top wall 141 in the up-down direction 53 and 54. The through-hole 98 serves as a hole for exposing the housing 62 (described later) protruding from an upper wall of the inner frame 35 to the outside when the inner frame 35 is accommodated in the front cover 32. Accordingly, the through-hole 98 is formed in the top wall 141 at a position, with a size and a shape corresponding to those of the housing 62.

The first light-blocking plate 67 is provided at the top wall 141 (top surface of the top wall 141) of the front cover 32 to protrude upward therefrom. The first light-blocking plate 67 extends in the front-rear direction 51 and 52. The first light-blocking plate 67 is positioned frontward of the housing 62 protruding from the upper wall of the inner frame 35. The first light-blocking plate 67 is disposed rearward of an electrical interface 60 (described later) provided on the top wall 141. The first light-blocking plate 67 is an example of a light-blocking plate.

The first light-blocking plate 67 is configured to block the light of the attachment sensor 113 traveling in the right-left direction 55 and 56. More specifically, when the ink cartridge 30 is attached to the cartridge-attachment section 110, the light emitted from the light-emitting element of the attachment sensor 113 is incident on the first light-blocking plate 67 before arriving at the light-receiving element. As a result, the intensity of light received at the light-receiving element is less than a predetermined intensity, for example, zero. Note that the first light-blocking plate 67 may completely block the light traveling in the right-left direction 55 and 56, or may partially attenuate the light, may refract the light to change a traveling direction thereof, or may fully reflect the light.

A support base 68 is provided at a position above the first protruding portion 85, that is, above the recess 96. The support base 68 has a bottom surface defining an upper end of the recess 96 and a top surface constituting the top wall 141 (top surface of the top wall 141) of the front cover 32. The top surface of the support base 68 is formed with a recessed portion 69 recessed downward. More specifically, the top surface of the support base 68 includes two planes arranged in V-shaped as viewed in the right-left direction 55 and 56 to define the recessed portion 69. However, the top surface of the support base 68 may have a curved surface forming a U-shape as viewed in the right-left direction 55 and 56, and the curved surface may function as the recessed portion 69. The recessed portion 69 is open in the right-left direction 55 and 56. The top surface of the support base 68 supports the electrical interface 60.

In the present embodiment, the top surface of the support base 68 constitutes the top wall 141 (top surface of the top wall 141) of the front cover 32. More specifically, the electrical interface 60 is supported directly by the top surface of the top wall 141 (i.e., top surface of the support base 68). However, the support base 68 may be provided on the top wall 141. That is, the top surface of the support base 68 may be independent of the top surface of the top wall 141 of the front cover 32. In this case, the electrical interface 60 may be supported to the top wall 141 indirectly from the top wall 141 with the support base 68 interposed between the electrical interface 60 and the top wall 141.

The electrical interface 60 includes the IC board 64 (an example of a circuit board) supported by the top surface of the support base 68, and the electrodes 65 provided on the surface of the IC hoard 64.

The IC board 64 is a flexible substrate having flexibility which is formed of a plastic film, for example. That is, the electrical interface 60 is formed in a sheet shape. The IC board 64 is bent so as to fit to the recessed portion 69 of the support base 68. Specifically, the IC board 64 has a recessed portion 70 recessed downward such that the recessed portion 70 is accessible from above. The IC board 64 has the surface 64A and a surface 64B in the recessed portion 70. The surface 64A has an area on which the electrodes 65A are provided, and a remaining area on which the electrodes 65A are not provided and therefore which is exposed. The surface 64B has an area on which the electrodes 65B are provided, and a remaining area on which the electrodes 65B are not provided and therefore which is exposed.

The surface 64A is inclined relative to the front-rear direction 51 and 52 such that a front edge of the surface 64A is positioned above a rear edge of the surface 64A. The surface 64A faces the rearward and upward. The surface 64B is inclined relative to the front-rear direction 51 and 52 such that a rear edge of the surface 64B is positioned above a front edge of the surface 64B. The surface 64B faces frontward and upward. The rear edge of the surface 64A and the front edge of the surface 64B are connected to each other.

Figure 6:
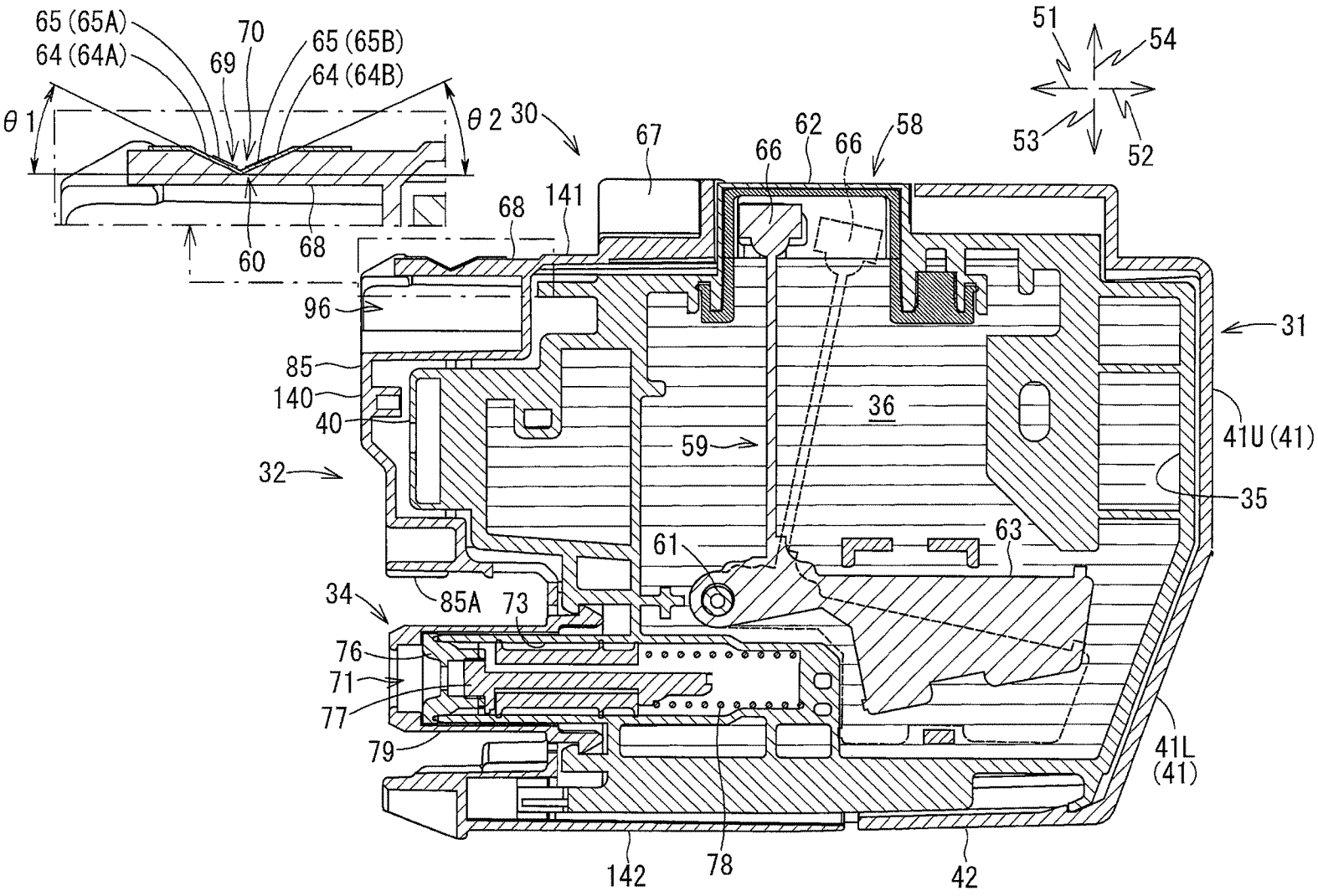
FIG. 6 is a vertical cross-sectional view illustrating an internal configuration of the ink cartridge according to the embodiment.

As illustrated in FIG. 6, the surface 64A is sloped relative to the front-rear direction 51 and 52, such that an angle θ1 defined between an extending direction of the surface 64A and the front-rear direction 51 and 52 is 30 degrees. Similarly, the surface 64B is sloped relative to the front-rear direction 51 and 52, such that an angle θ2 defined between an extending direction of the surface 64B and the front-rear direction 51 and 52 is 30 degrees. Note that the angles θ1 and θ2 may be arbitrary as long as the angles θ1 and θ2 are smaller than or equal to 30 degrees, respectively.

Figure 3A:
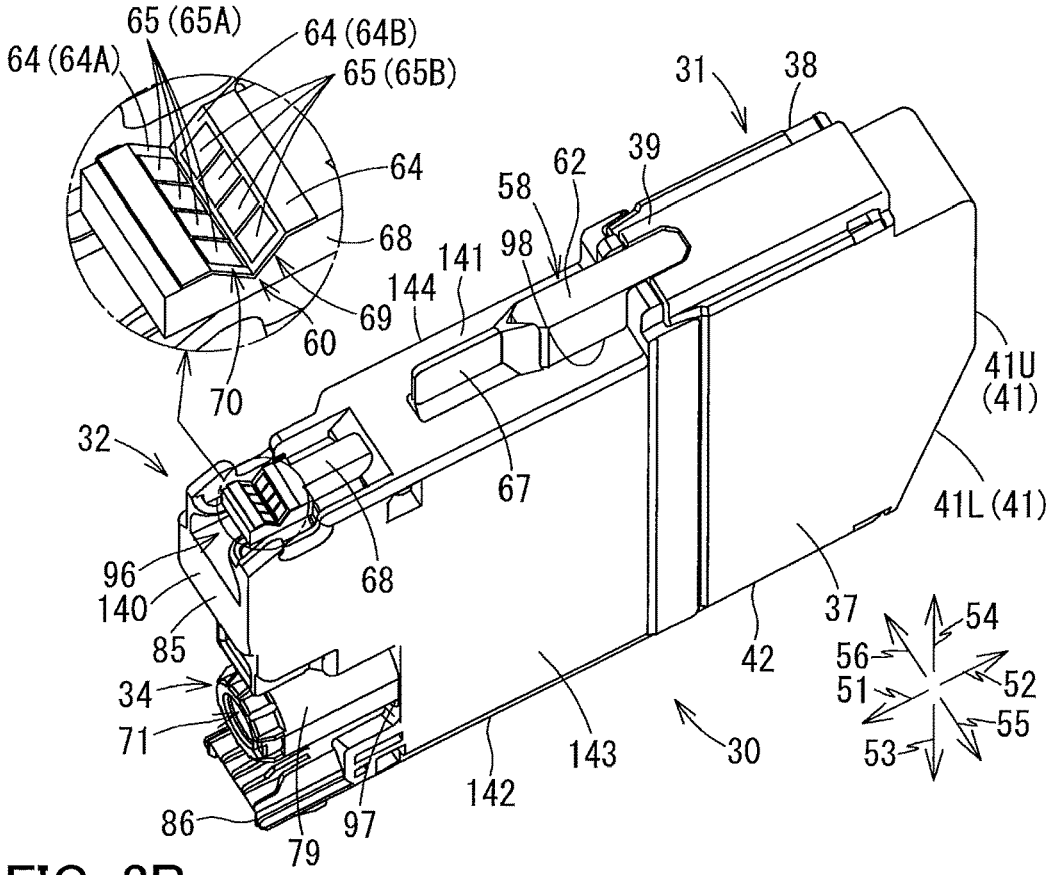
FIG. 3A is a perspective view showing an external appearance of the ink cartridge according to the embodiment when viewed from a perspective frontward and upward of the ink cartridge.
Figure 3B:
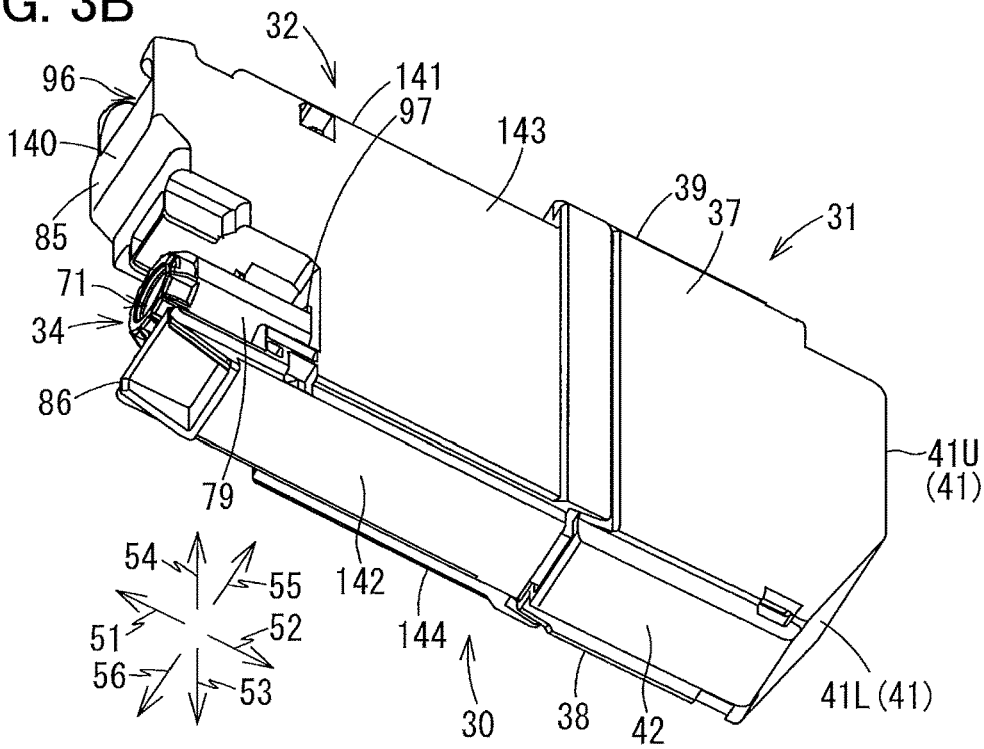
FIG. 3B is a perspective view showing the external appearance of the ink cartridge according to the embodiment when viewed from a perspective frontward and downward of the ink cartridge.
Figure 4A:
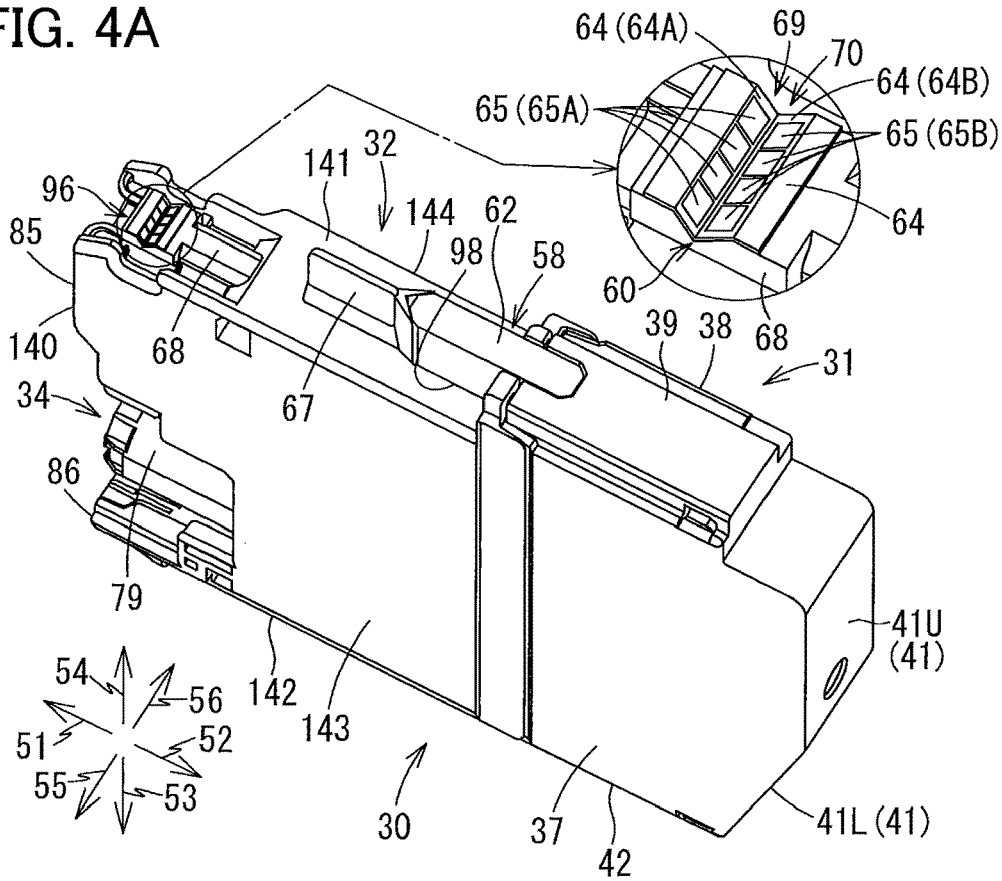
FIG. 4A is a perspective view showing the external appearance of the ink cartridge according to the embodiment when viewed from a perspective rearward and upward of the ink cartridge.
Figure 4B:
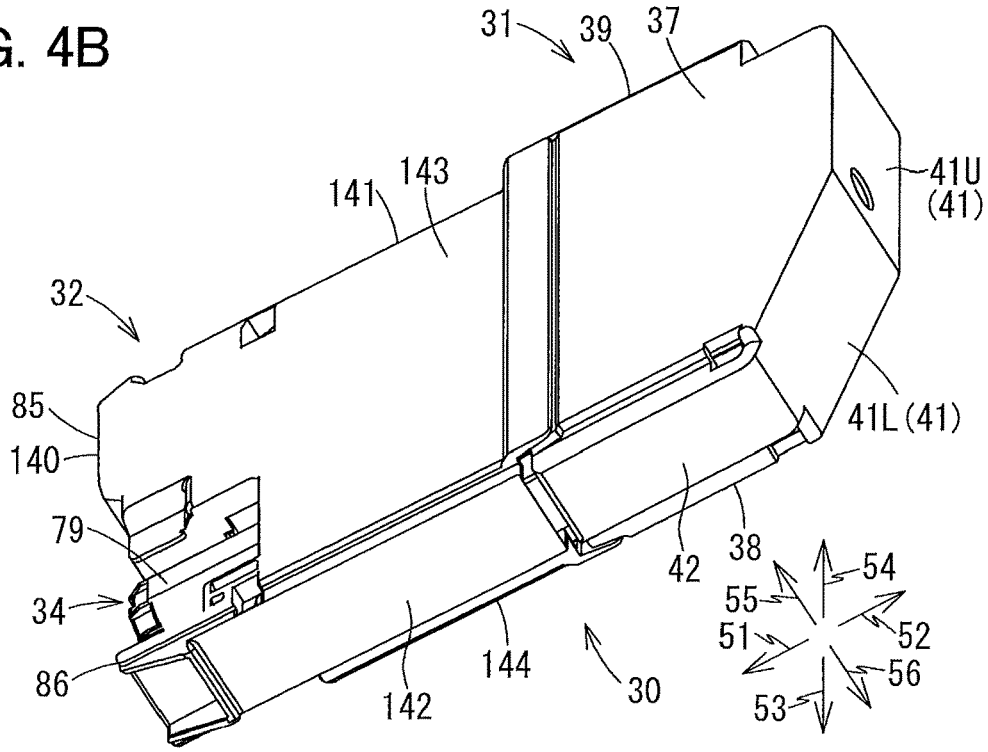
FIG. 4B is a perspective view showing the external appearance of the ink cartridge according to the embodiment when viewed from a perspective rearward and downward of the ink cartridge.
Figure 5:
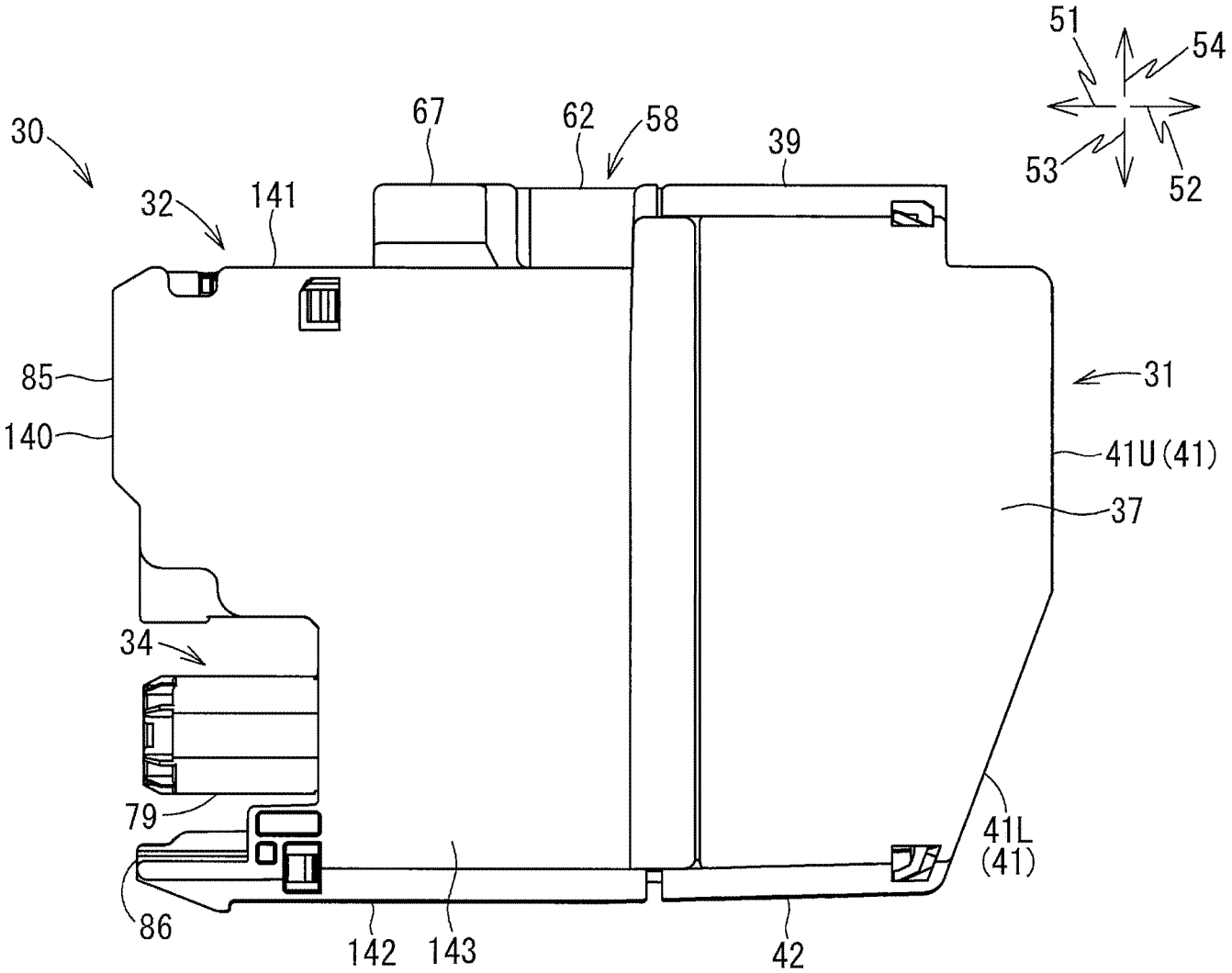
FIG. 5 is a side view of the ink cartridge according to the embodiment.

As shown in FIGS. 3A and 4A, the four electrodes 65A, the four electrodes 65B, and the IC (not shown) are mounted on the IC board 64. The four electrodes 65A are formed on the surface 64A, and the four electrodes 65B are formed on the surface 64B. Each of the four electrodes 65A corresponds to each one of the four electrodes 65B, and the respective electrodes 65A are electrically connected to the corresponding electrodes 65B.

The four electrodes 65A are arranged to be spaced apart from each other in the right-left direction 55 and 56. Similarly, the four electrodes 65B are arranged to be spaced apart from each other in the right-left direction 55 and 56. The electrodes 65A and 65B extend in the front-rear direction 51 and 52. The electrodes 65A and 65B are disposed on the top surface of the IC board 64 such that the electrodes 65A and 65B are electrically accessible.

As illustrated in FIG. 6, each of the electrodes 65A has a thickness greater than a thickness of each of the electrodes 65B. That is, in the electrical interface 60, a part including electrodes 65A and a part of the IC board 64 on which the electrodes 65A are provided (an example of a first portion) is thicker than a part including the electrodes 65B and a part of the IC board 64 on which the electrodes 65B are provided (an example of a second portion).

The IC is a semiconductor integrated circuit and readably stores data indicating information on the ink cartridge 30, such as a lot number, a production date, and a color of the ink. The electrodes 65A and 65B are electrically connected to the IC.

The electrodes 65 of the IC board 64 are electrically connected to the corresponding four contacts 106 (see FIG. 2) arranged in the right-left direction 55 and 56 during insertion of the ink cartridge 30 into the cartridge-attachment section 110, as well as when the ink cartridge 30 is attached to the cartridge-attachment section 110.

<Inner Frame 35>

Although not illustrated in the drawings, the inner frame 35 is formed in a generally annular shape, with a pair of side surfaces in the right-left direction 55 and 56 is opened. The respective open surfaces of the inner frame 35 are sealed with films (not shown) to form the ink chamber 36 for storing ink in the inner frame 35. The inner frame 35 includes a front wall 40 that defines a part of the ink chamber 36. The front wall 40 faces the front wall 140 of the front cover 32 when the inner frame 35 is accommodated in the front cover 32. More specifically, a front surface of the front wall 40 faces a rear surface (opposite the front surface) of the front wall 140 when the inner frame 35 is accommodated in the front cover 32. The ink supply portion 34 is disposed at the front wall 40.

<Ink Supply Portion 34>

As shown in FIG. 6, the ink supply portion 34 (an example of a liquid supply portion) protrudes frontward from the front wall 40 of the inner frame 35. The ink supply portion 34 has a cylindrical outer shape, and protrudes outward through the through-hole 97 formed in the front wall 140 of the front cover 32. That is, the ink supply portion 34 is positioned at the lower end portion of the front wall 140.

The ink supply portion 34 includes a cylindrical-shaped tubular wall 73 defining an internal space therein, a sealing member 76 and a cap 79. The sealing member 76 and cap 79 are attached to the tubular wall 73.

The tubular wall 73 extends to connect the interior and exterior of the ink chamber 36. The tubular wall 73 has a rear end that is opened in the ink chamber 36. The tubular wall 73 has a front end that is opened to the outside of the ink cartridge 30. Accordingly, the tubular wall 73 provides fluid communication between the ink chamber 36 and the outside of the ink cartridge 30 through the internal space of the tubular wall 73. The ink supply portion 34 can thus supply the ink stored in the ink chamber 36 to the outside of the ink cartridge 30 via the internal space of the tubular wall 73. The sealing member 76 and the cap 79 are attached to the front end of the tubular wall 73.

In the internal space of the tubular wall 73, a valve 77 and a coil spring 78 are accommodated. The valve 77 and the coil spring 78 are examples of an urging member and a valve. The valve 77 and the coil spring 78 serve to selectively switch states of the ink supply portion 34 between a state shown in FIG. 11 and a state shown in FIG. 6. That is, in the state shown in FIG. 11, the ink is allowed to flow out of the ink chamber 36 to the outside of the ink cartridge 30 via the internal space of the tubular wall 73. In the state shown in FIG. 6, the ink is not allowed to flow out of the internal space of the tubular wall 73 to the outside of the ink cartridge 30.

The valve 77 is movable in the front-rear direction 51 and 52 to open and close the ink supply port 71 (an example of a liquid outlet) formed at a center of the sealing member 76. The coil spring 78 biases the valve 77 frontward. Accordingly, without application of an external force, the valve 77 closes the ink supply port 71 of the sealing member 76.

The sealing member 76 is attached to the front end of the tubular wall 73. The sealing member 76 is formed of an elastic material such as rubber or elastomer. The sealing member 76 is a disc-like shaped and has a center portion in which a through-hole is formed. The through-hole penetrates through the center portion of the sealing member 76 in the front-rear direction 51 and 52 to provide a tubular-shaped inner circumferential surface that defines the ink supply port 71. The ink supply port 71 has a diameter that is slightly smaller than an outer diameter of the ink needle 102. The cap 79 is externally fitted to the tubular wall 73, with the sealing member 76 attached to the front end of the tubular wall 73, such that the sealing member 76 is in liquid-tight contact with the front end of the tubular wall 73.

When the ink cartridge 30 is inserted into the cartridge-attachment section 110 in a state where the valve 77 closes the ink supply port 71, the ink needle 102 enters into the ink supply port 71. An outer circumferential surface of the ink needle 102 is brought into contact with the inner circumferential surface defining the ink supply port 71 to provide a liquid-tight seal therewith, while elastically deforming the sealing member 76. When a tip portion of the ink needle 102 moves past the sealing member 76 and enters into the internal space of the tubular wall 73, the ink needle 102 comes in contact with the valve 77. As the ink cartridge 30 is further inserted into the cartridge-attachment section 110, the ink needle 102 moves the valve 77 rearward against a biasing force of the coil spring 78, thereby opening the ink supply port 71. Accordingly, the ink stored in the ink chamber 36 can flow into the tip portion of the ink needle 102 via the internal space of the tubular wall 73. Although not illustrated in the drawings, ink flows from the internal space of the tubular wall 73 into an internal space of the ink needle 102 via through-holes formed in the tip portion of the ink needle 102. Accordingly, the ink stored in the ink chamber 36 can flow outside the ink cartridge 30 through the internal space of the tubular wall 73 and through the ink needle 102.

The ink supply portion 34 may not be provided with the valve 77 for closing the ink supply port 71. Instead, for example, the ink supply port 71 may be closed with a film. In this case, the ink needle 102 may break through the film at the time of insertion of the ink cartridge 30 into the cartridge-attachment section 110, thereby allowing the tip portion of the ink needle 102 to enter inside the internal space of the tubular wall 73 through the ink supply port 71. Still alternatively, the ink supply port 71 may be closed with an elastic force of the sealing member 76 itself. In this case, the ink supply port 71 may be pushed and enlarged by the ink needle 102 only when the ink needle 102 is inserted in the ink supply port 71.

<Residual-Amount Detection Portion 58>

A residual-amount detection portion 58 (an example of a detection portion) is configured to change a state of the light emitted from the outside of the ink cartridge 30 (i.e., from the residual-amount sensor 103 of the cartridge-attachment section 110) depending on the states of the ink cartridge 30 (i.e., an amount of residual ink in the ink cartridge 30).

As illustrated in FIG. 6, the residual-amount detection portion 58 includes the housing 62 and a sensor arm 59.

The housing 62 protrudes upward from the upper wall of the inner frame 35. The housing 62 is exposed to the outside through the through-hole 98 formed in the front cover 32 such that the housing 62 protrudes upward relative to the top wall 141 of the front cover 32. The housing 62 defines an internal space therein that is in communication with the ink chamber 36. The housing 62 can allow light to pass therethrough in the right-left direction 55 and 56. That is, the housing 62 has light-transmissive properties.

The sensor arm 59 is disposed in the ink chamber 36 of the inner frame 35. The sensor arm 59 is supported by a pivot shaft 61 extending in the right-left direction 55 and 56. The sensor arm 59 is pivotably movable about the pivot shaft 61. The sensor arm 59 includes a float 63 and a second light-blocking plate 66 (an example of a light-receiving portion).

The float 63 has a specific gravity smaller than a specific gravity of the ink stored in the ink chamber 36. Accordingly, in the ink chamber 36, buoyancy is generated on the float 63 as long as the float 63 is in the ink. In other words, in a state where the ink chamber 36 is almost filled with the ink, the sensor arm 59 is urged to pivot counterclockwise in FIG. 6 due to the buoyancy generated on the float 63. Hereinafter, the ink chamber 36 is assumed to be filled with ink and the sensor arm 59 is assumed to be in a posture indicated by a solid line in FIG. 6.

The second light-blocking plate 66 is plate-shaped. The second light-blocking plate 66 is disposed in the housing 62 of the inner frame 35. Specifically, the second light-blocking plate 66 is located higher relative to the top wall 141 of the front cover 32. Since the sensor arm 59 is urged to pivot counterclockwise in FIG. 6, the second light-blocking plate 66 is in contact with a wall defining a front end of the housing 62. Due to this contact, the sensor arm 59 is maintained in the posture indicated by the solid line shown in FIG. 6. In this state shown in FIG. 6, the second light-blocking plate 66 blocks the light from the residual-amount sensor 103 traveling through the housing 62 in the right-left direction 55 and 56. The position of the second light-blocking plate 66 at this time is referred to as a detection position (indicated by the solid line in FIG. 6).

More specifically, when the light emitted from the light-emitting element of the residual-amount sensor 103 is incident on the second light-blocking plate 66 before arriving at the light-receiving element, the intensity of the light received at the light-receiving element is less than a predetermined intensity, for example, zero. Note that the second light-blocking plate 66 may completely block the light traveling in the right-left direction 55 and 56, may partially attenuate the light, may refract the light to change a traveling direction thereof, or may totally reflect the light.

When the amount of ink decreases in the ink chamber 36 and a liquid surface of the ink becomes lower than the position of the float 63 indicated by the solid line in FIG. 6 (the position of the float 63 when the sensor arm 59 is in the posture in which the second light-blocking plate 66 blocks the light traveling through the housing 62), the float 63 starts to move downward, following the declining liquid surface of the ink. In accordance with the downward movement of the float 63, the sensor arm 59 is pivoted clockwise in FIG. 6, thereby moving a part of the second light-blocking plate 66 within the housing 62 out of an optical path formed by the light traveling from the light-emitting element to the light-receiving element at the residual-amount sensor 103. Accordingly, the intensity of the light received at the light-receiving element of the residual-amount sensor 103 is equal to or greater than the predetermined intensity. The position of the second light-blocking plate 66 at this time (the position indicated by a dotted line in FIG. 6) is a non-detection position that is different from the detection position.

<Positional Relationship Between Electrical Interface 60 and Second Light-Blocking Plate 66 of Residual-Amount Detection Portion 58>

As illustrated in FIG. 6, the electrical interface 60 is positioned frontward and downward relative to the second light-blocking plate 66 of the residual-amount detection portion 58. More specifically, the electrodes 65 of the electrical interface 60 are disposed frontward and downward relative to the second light-blocking plate 66 in the detection position. Also, the electrodes 65 of the electrical interface 60 are disposed frontward and downward relative to the first light-blocking plate 67.

<Attachment/Detachment of the Ink Cartridge 30 Relative to the Cartridge-Attachment Section 110>

Next, a process for attaching the ink cartridge 30 to the cartridge-attachment section 110 will be described.

As shown in FIG. 7, before the ink cartridge 30 is inserted into the cartridge-attachment section 110, the valve 77 closes off the ink supply port 71 of the sealing member 76. Accordingly, at this time, ink flow from the ink chamber 36 to the outside of the ink cartridge 30 is interrupted.

Also, as shown in FIG. 7, prior to attachment of the ink cartridge 30 to the cartridge-attachment section 110, nothing is located between the light-emitting element and the light-receiving element of the residual-amount sensor 103. The residual-amount sensor 103 therefore outputs a high-level signal to the controller of the printer 10. Likewise, since nothing is located between the light-emitting element and the light-receiving element of the attachment sensor 113, the attachment sensor 113 outputs a high-level signal to the controller of the printer 10.

For attaching the ink cartridge 30, the ink cartridge 30 is inserted into the case 101 of the cartridge-attachment section 110 through the opening 112, as shown in FIG. 7. Since the upper portion 41U of the rear wall 41 of the rear cover 31 is positioned rearward relative to the lower portion 41L of the rear wall 41, that is, since the upper portion 41U is positioned closer to the user than the lower portion 41L is to the user, the user can push the upper portion 41U to insert the ink cartridge 30 frontward into the cartridge-attachment section 110.

As described above, the user is encouraged to push the upper portion 41U, due to the sheet attached to the upper portion 41U for prompting the user to push the upper portion 41U (such as a text such as "PUSH," a sign such as an arrow, or a figure illustrating pushing with a finger). At the time of insertion of the ink cartridge 30 into the case 101 of the cartridge-attachment section 110, a lower portion of the ink cartridge 30, that is, the lower portions of the front cover 32 and the rear cover 31, are inserted into the corresponding lower guide groove 109 formed in the case 101.

As the ink cartridge 30 is further inserted frontward from the state shown in FIG. 7, the ink cartridge 30 reaches a state shown in FIG. 8. At this time, as shown in FIG. 8, the cap 79 of the ink supply portion 34 starts entering into the guide portion 105. The recess 96 of the front cover 32 faces the rod 125, and the rod 125 starts moving into the recess 96.

Further, the first light-blocking plate 67 comes to a location between the light-emitting element and the light-receiving element of the residual-amount sensor 103. As a result, the residual-amount sensor 103 outputs a low-level signal, instead of the high-level signal, to the controller of the printer 10. That is, the signal outputted from the residual-amount sensor 103 is changed from high level to low level. On the other hand, the attachment sensor 113 continues to output the high-level signal to the controller of the printer 10.

As the ink cartridge 30 is further inserted frontward from the state shown in FIG. 8, the ink cartridge 30 reaches a state shown in FIG. 9. As shown in FIG. 9, the tip portion of the ink needle 102 enters into the ink supply port 71 and comes closer to the valve 77.

Further, as shown in FIG. 9, the first light-blocking plate 67 is still positioned at a position between the light-emitting element and the light-receiving element of the residual-amount sensor 103. Therefore, the residual-amount sensor 103 continues to output the low-level signal to the controller of the printer 10. On the other hand, nothing is located between the light-emitting element and the light-receiving element of the attachment sensor 113, and thus the signal outputted from the attachment sensor 113 to the controller of the printer 10 is maintained at the high level.

Further, at this time, a bottom surface 85A (as an example of a positioning surface) facing downward of the first protruding portion 85 is supported by a surface 170 constituting the case 101 of the cartridge-attachment section 110, the surface 170 facing upward and being positioned above the guide portion 105. Due to this contact between the bottom surface 85A and the surface 170, the ink cartridge 30 is fixed in position in the up-down direction 53 and 54. Incidentally, the bottom surface 85A is arranged to overlap with the IC board 64 when the ink cartridge 30 is viewed from above. That is, the bottom surface 85A has a portion aligned with the IC board 64 in the up-down direction 53 and 54. Alternatively, instead of the surface 170, the rod 125 may function to support the attached ink cartridge 30 to provide positioning of the ink cartridge 30 in the up-down direction 53 and 54, for example.

In the state shown in FIG. 9, the rod 125 is positioned in the recess 96 of the front cover 32 to support the front cover 32 from below. Also, the support base 68 contacts the surfaces 106A of the contacts 106 from its rear side. Accordingly, the contacts 106 are upwardly resiliently deformed.

Figure 10:
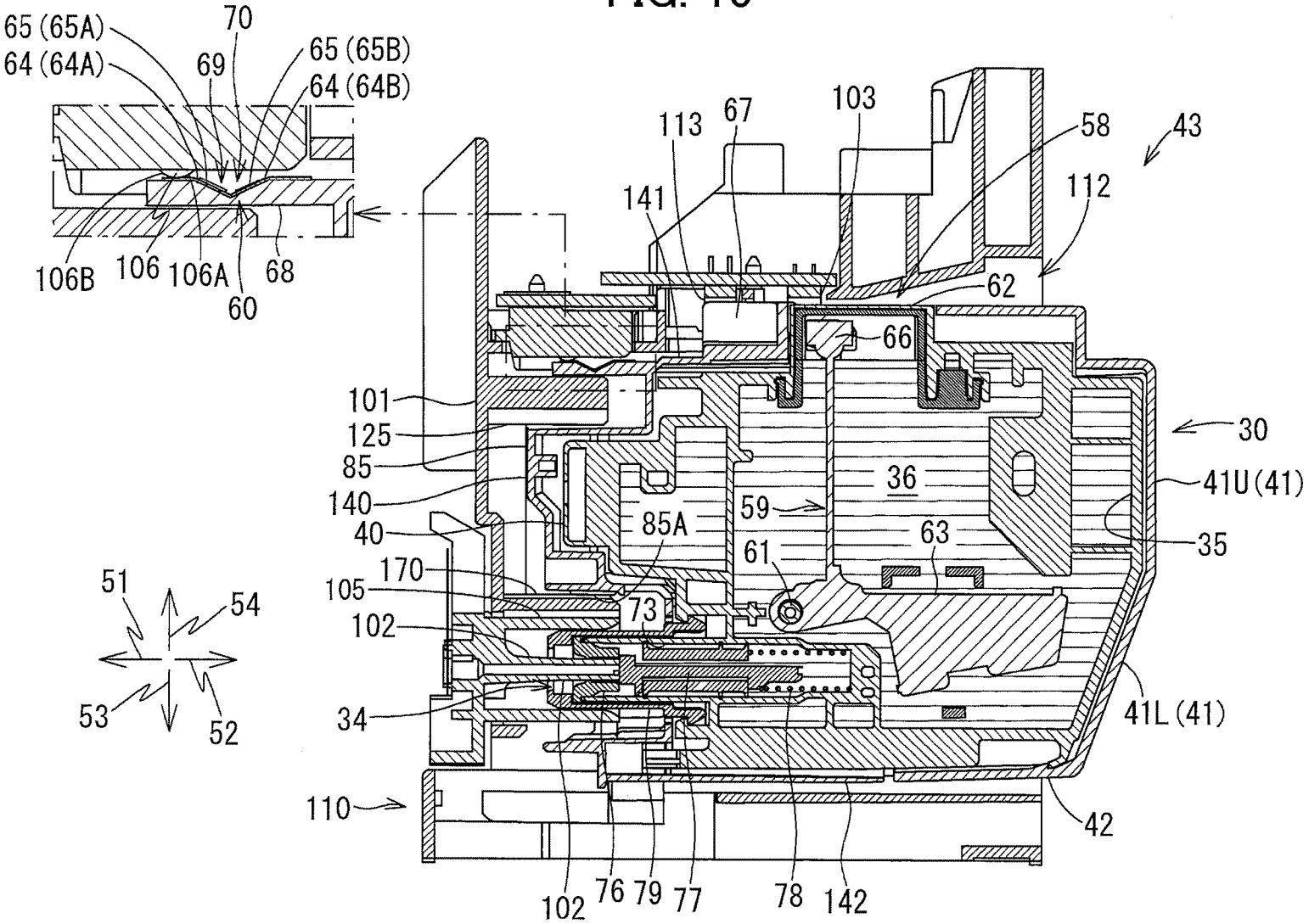
FIG. 10 is a vertical cross-sectional view illustrating the ink cartridge according to the embodiment and the cartridge-attachment section, and illustrating a state where; the ink needle enters into the ink supply port of the ink supply portion; and the support base supports the contact from below.

As the ink cartridge 30 is further inserted frontward from the state shown in FIG. 9, the ink cartridge 30 reaches a state shown in FIG. 10. As shown in FIG. 10, the cap 79 of the ink supply portion 34 enters into the guide portion 105 and the ink needle 102 moves past the ink supply port 71 to separate the valve 77 from the sealing member 76 against the biasing force of the coil spring 78. The ink cartridge 30 is applied with the biasing force of the coil spring 78 to be urged rearward.

Further, in the state shown in FIG. 10, the second light-blocking plate 66 is located between the light-emitting element and the light-receiving element of the residual-amount sensor 103. Therefore, the signal outputted from the residual-amount sensor 103 to the controller of the printer 10 is maintained at the low level. Also, the first light-blocking plate 67 is located between the light-emitting element and the light-receiving element of the attachment sensor 113. The signal outputted from the attachment sensor 113 to the controller of the printer 10 is changed from the high level to the low level. Accordingly, the controller of the printer 10 recognizes that the ink cartridge 30 has been attached to the cartridge-attachment section 110.

Further, as shown in FIG. 10, the contacts 106 upwardly resiliently deformed are supported to the support base 68.

As the ink cartridge 30 is further inserted frontward from the state shown in FIG. 10 against the biasing force of the coil spring 78, the ink cartridge 30 reaches a state shown in FIG. 11. As shown in FIG. 11, the contacts 106 are positioned in the recessed portion 70. Here, since the ink cartridge 30 is urged rearward by the biasing force of the coil spring 78, the surfaces of the electrodes 65A provided on the surface 64A are brought into contact with the corresponding surfaces 106B of the contacts 106 from its front side. This contact between the surfaces of the electrode 65A and the surfaces 106B can restrict the ink cartridge 30 from moving rearward due to the biasing force of the coil spring 78. That is, the ink cartridge 30 is fixed in position relative to the cartridge-attachment section 110, thereby completing attachment of the ink cartridge 30 to the cartridge-attachment section 110. At this time, the ink cartridge 30 is in the attached state. That is, the ink cartridge 30 is maintained in the attached state by the contact between the surfaces of the electrodes 65A and the surfaces 106B.

Since the surfaces of the electrodes 65A contact the surfaces 106B of the contacts 106 from the front side, the electrodes 65A are electrically connected to the corresponding contacts 106. Also, the electrodes 65B formed on the surfaces 64B can be electrically connected to the corresponding contacts 106. At this time, the IC board 64 is urged downward by the resilient deformation of the contacts 106. However, since the rod 125 supports the front cover 32 from below, the IC board 64 can be positioned accurately relative to the contacts 106. Here, the rod 125 may not necessarily support the front cover 32 from below. Rather, for example, some annular member provided around the ink needle 102 may contact the front cover 32 to support the front cover 32.

As the ink flows out from the ink cartridge 30 in the attached state to the recording head 21 and is consumed by the recording head 21, the amount of ink stored in the ink chamber 36 decreases. In accordance with reduction in the amount of ink left in the ink chamber 36, the part of the second light-blocking plate 66, which was located in the housing 62, is moved to a position offset from the optical path formed by the light from the light-emitting element to the light-receiving element of the residual-amount sensor 103. Accordingly, the signal outputted from the residual-amount sensor 103 to the controller of the printer 10 is changed from the low level to the high level. The controller of the printer 10 therefore recognizes that the residual amount of ink in the ink chamber 36 has been reduced.

Next, a process for removing the ink cartridge 30 in the attached state from the cartridge-attachment section 110 will be described.

When the user grasps and pulls the ink cartridge 30 in the attached state rearward, each of the surfaces of the electrodes 65A formed on the surface 64A presses the surface 106B of the corresponding contact 106 from its front side. At this time, when the amount of the pressing force which the surfaces of the electrodes 65A apply onto the corresponding surfaces 106B is larger than that of the biasing force of the coil spring 78, the contacts 106 are upwardly resiliently deformed. More specifically, when the ink cartridge 30 is in the attached state, a reaction force of the biasing force of the coil spring 78 generates a moment of force acting on the ink cartridge 30. The moment of force is for moving the ink cartridge 30 in a counterclockwise direction, that is, a direction to separate the surfaces of the electrodes 65A away from the surfaces 106B of the contacts 106. Accordingly, in a case where the ink cartridge 30 in the attached state is pulled rearward and when the amount of the pressing force, by which the surfaces of the electrodes 65A are pressed against the surfaces 106B, is greater than the amount of force that is generating the moment of force (reaction force of the biasing force of the coil spring 78), the contacts 106 are deformed upwardly to retract from the passage of the electrodes 65.

As a result, as shown in FIG. 10, the contacts 106 which are now upwardly resiliently deformed become supported by the support base 68. When the ink cartridge 30 is further moved rearward, the support base 68 is positioned rearward relative to the contacts 106. Since the rearward movement of the ink cartridge 30 is no longer restricted, the ink cartridge 30 is now allowed to move rearward as the user withdraws the ink cartridge 30 rearward. The ink cartridge 30 is further moved rearward, and the ink cartridge 30 is finally detached from the cartridge-attachment section 110.

When the ink cartridge 30 in the attached state is moved rearward, the first light-blocking plate 67 is also moved rearward to be displaced from the position between the light-emitting element and the light-receiving element of the attachment sensor 113. Accordingly, the signal outputted from the attachment sensor 113 to the controller of the printer 10 is changed from the low level to the high level, thereby enabling the controller to detect that the ink cartridge 30 is detached from the cartridge-attachment section 110.

<Operational and Technical Advantages of the Embodiment>

When the attached ink cartridge 30 is fixed in position relative to the cartridge-attachment section 110 at the ink supply portion 34 as in the above-described embodiment, it is likely that the attached ink cartridge 30 may be applied with a force acting to pivotally move the ink cartridge 30 about the ink supply portion 34. However, in the ink cartridge 30 according to this embodiment, the surface 64A of the IC board 64 is positioned closer to the ink supply portion 34 than both of the second light-blocking plate 66 and the first light-blocking plate 67 are to the ink supply portion 34 in the front-rear direction 51 and 52. That is, the surface 64A of the IC board 64 is disposed at a position closer to the pivot center (i.e., ink supply portion 34) of the ink cartridge 30 than both of the second light-blocking plate 66 and the first light-blocking plate 67 are to the pivot center of the ink cartridge 30 in the front-rear direction 51 and 52. Accordingly, in the attached state of the ink cartridge 30, this configuration can reduce deviations in the positions of the surface 64A of the IC board 64, in comparison with a configuration in which the surface 64A of the IC board 64 is positioned farther away from the pivot center of the ink cartridge 30 than the second light-blocking plate 66 or the first light-blocking plate 67 is from the pivot center of the ink cartridge 30. That is, the ink cartridge 30 in the attached state can be maintained in a stable posture.

Further, according to the embodiment, since the surface 64A of the IC board 64 is positioned downward relative to the second light-blocking plate 66, the length of a part of the ink cartridge 30 at which the surface 64A of the IC board 64 is provided in the up-down direction 53 and 54 can be suppressed to be small.

Further, according to the embodiment, the surfaces of the electrodes 65A serving as an engaging surface constitutes at least a part of the recessed portion 70 of the electrical interface 60. Accordingly, the surfaces of the electrodes 65A can be used both as an electrical contact surface at which electrical connection is achieved and as the engaging surface.

Further, according to the embodiment, since the electrode 65A has the thickness larger than that of the electrode 65B, an amount of a sliding load required to move the ink cartridge 30 in the attached state rearward can be increased. Accordingly, rearward movement of the ink cartridge 30 in the attached state can be more reliably restricted.

Further, according to the embodiment, the surface 64A is sloped relative to the front-rear direction 51 and 52 such that the angle defined between the surface 64A and the front-rear direction 51 and 52 is smaller than or equal to 30 degrees. Accordingly, the length of the part of the ink cartridge 30 at which the surface 64A of the IC board 64 is provided in the up-down direction 53 and 54 can be suppressed to be small.

Further, according to the embodiment, since the IC board 64 has flexibility, the recessed portion 70 can be easily provided.

Further, according to the embodiment, the coil spring 78 is provided at the ink supply portion 34. Accordingly, when the ink cartridge 30 is pulled rearward by a user and rearward movement of the ink cartridge 30 becomes no longer restricted due to engagement between the surface of the electrode 65A of the surface 64A and the surfaces 106B, the ink cartridge 30 can be automatically moved rearward by the biasing force of the coil spring 78.

Further, according to the embodiment, the ink cartridge 30 is fixed in position relative to the cartridge-attachment section 110 at a position vertically below the surface 64A of the IC board 64 due to the contact between the bottom surface 85A and the surface 170 of the cartridge-attachment section 110. Accordingly, the reliable engagement between the surfaces of the electrodes 65A and the contacts 106 of the cartridge-attachment section 110 can be realized, thereby stably maintaining the ink cartridge 30 in the attached state.

<Variations and Modifications>

In the above-described embodiment, the support base 68 presses the contacts 106 to be upwardly resiliently deformed, thereby enabling the ink cartridge 30 to be attached to and detached from the cartridge-attachment section 110. However, the process of the attachment and detachment of the ink cartridge 30 to and from the cartridge-attachment section 110 is not limited to the processes described in the embodiment.

For example, the surfaces of the electrodes 65A of the surface 64A may be engaged with and disengaged from the surfaces 106B of the contacts 106 by pivotally moving the ink cartridge 30 relative to the cartridge-attachment section 110. In this case, the ink cartridge 30 in the attached state may be pivotally moved between a first posture (the posture of the ink cartridge 30 shown in FIG. 11) in which the surfaces of the electrodes 65A facing rearward and upward are disposed frontward relative to the surfaces 106B facing downward and frontward and in contact with the surfaces 106B, and a second posture (the posture of the ink cartridge 30 shown in FIG. 12) in which the surface 64A of the IC board 64 are positioned below the surfaces 106B and being out of contact with the surfaces 106B.

Figure 12:
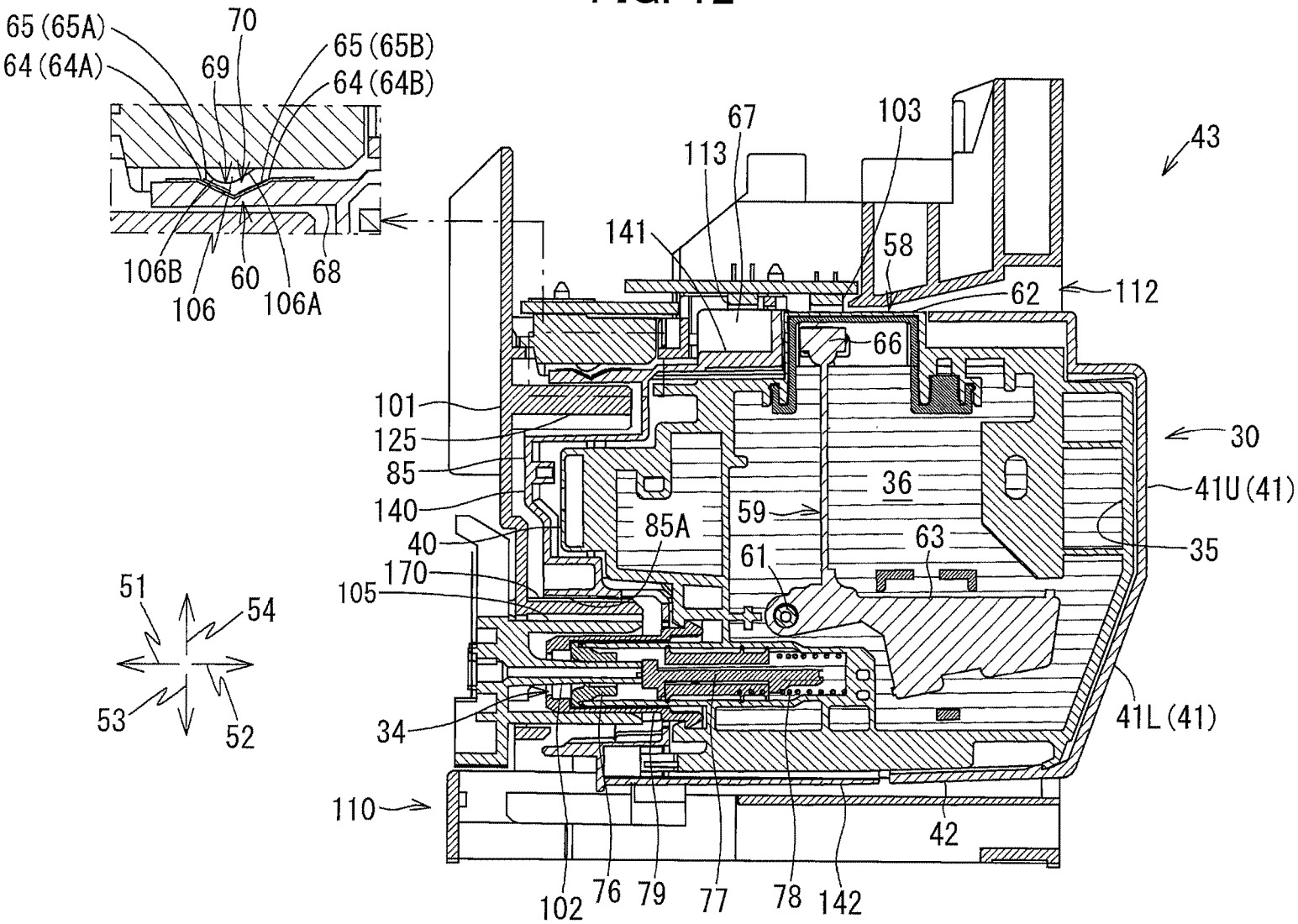
FIG. 12 is a vertical cross-sectional view illustrating an ink cartridge according to a modification to the embodiment and the cartridge-attachment section, and illustrating a state where a surface of an IC board is positioned below relative to contact.

Specifically, in order to detach the ink cartridge 30 from the cartridge-attachment section 110, in the state shown in FIG. 11, the ink cartridge 30 is pivotally moved counterclockwise in FIG. 11 about a center of the ink supply port 71 of the sealing member 76 into which the ink needle 102 is inserted. That is, the ink cartridge 30 is pivotally moved counterclockwise about a center portion of a part of the ink needle 102 that is in contact with the inner circumferential surface of the sealing member 76 defining the ink supply port 71. As a result, the ink cartridge 30 is pivotally moved from the first posture to the second posture, so that the surface 64A of the IC board 64 are positioned below the contacts 106 as shown in FIG. 12. By keeping the ink cartridge 30 in the second posture and moving the ink cartridge 30 rearward, the ink cartridge 30 can be detached from the cartridge-attachment section 110.

On the other hand, in order to attach the ink cartridge 30 to the cartridge-attachment section 110, in the state shown in FIG. 9, the ink cartridge 30 is pivotally moved counterclockwise in FIG. 9 about the pivot center described above. Accordingly, the ink cartridge 30 is pivotally moved to the second posture, and thus the surface 64A of the IC board 64 is positioned below the contacts 106. While being kept in the second posture, the ink cartridge 30 is moved frontward until the surface 64A of the IC hoard 64 are positioned frontward relative to the contacts 106 (see FIG. 12). Thereafter, the ink cartridge 30 is pivotally moved clockwise in FIG. 12. Accordingly, the ink cartridge 30 is in the attached state (see FIG. 11).

In the above-described modification, the ink cartridge 30 in the first posture is pivotally moved counterclockwise to be moved to the second posture. However, the ink cartridge 30 in the first posture may be pivotally moved clockwise to a third posture rather than the second posture, in which the surface 64A of the IC board 64 are positioned below the surfaces 106B of the contacts 106. That is, in a case where the front cover 32 is not supported by the rod 125 (i.e., the support base 68 and the rod 125 are disposed with a space therebetween), during detachment of the ink cartridge 30 from the cartridge-attachment section 110, the ink cartridge 30 is pivotally moved clockwise to separate the surface 64A of the IC board 64 from the surface 106B of the contact 106. Accordingly, the ink cartridge 30 can be moved rearward by the biasing force of the coil spring 78.

In the above-described embodiment, due to engagement between the surfaces (the engaging surface) of the electrodes 65A provided on the surface 64A of the electrical interface 60 and the surfaces 106B (the engaged surface) of the contacts 106, the ink cartridge 30 is maintained in the attached state. However, a combination of other surfaces may be employed as the combination of an engaging surface and an engaged surface for maintaining the ink cartridge 30 in the attached state instead of the surfaces of the electrodes 65A and the surfaces 106B.

For example, the first light-blocking plate 67 may include an engaging surface facing rearward on the top surface thereof and the cartridge-attachment section 110 may include an engaged surface facing frontward and disposed at a position corresponding to the engaging surface. By engaging the engaging surface of the first light-blocking plate 67 with the engaged surface of the cartridge-attachment section 110, the ink cartridge 30 may be maintained in the attached state.

Note that the respective positions of the engaging surface and the engaged surface may be other than the above-described positions provided that the engaging surface is positioned frontward relative to the second light-blocking plate 66 of the residual-amount detection portion 58. For example, the engaging surface may be positioned frontward relative to the IC board 64, may be positioned at a position between the IC board 64 and the first light-blocking plate 67 in the front-rear direction 51 and 52, or may be positioned at the bottom wall 142. In this case, the engaged surface is disposed at a position corresponding to the engaging surface.

In the above-described embodiment, reduction in the residual amount of ink in the ink chamber 36 is detected by the sensor arm 59 pivoting within the ink chamber 36 to displace the second light-blocking plate 66 of the sensor arm 59 from the path of the light traveling from the light-emitting element to the light-receiving element of the residual-amount sensor 103. However, detection of the residual amount of ink in the ink chamber 36 may be performed through a different configuration from the above-described embodiment.

For example, the ink cartridge 30 may not include the sensor arm 59. Instead, the housing 62 may have a prism shape so as to bend a traveling direction of light emitted from the light-emitting element of the residual-amount sensor 103 depending on presence or absence of ink in the housing 62. In this case, the housing 62 is an example of a detection portion.

Alternatively, the ink cartridge 30 may include a light-emitting device, instead of the housing 62 and the sensor arm 59. The light-emitting device may incorporate a battery therein, and may be configured to emit light at a predetermined timing to notify the controller that the amount of residual ink in the ink chamber 36 becomes smaller. Here, the predetermined timing may be, for example, such a timing at which a prescribed number of days that are expected to be required for consuming a predetermined amount of ink have elapsed since the printer 10 is first turned on. In this case, the light-emitting device is an example of a detection portion.

While the residual-amount detection portion 58 (for detecting the residual amount of ink) serves as a detection portion in the above-described embodiment, the detection portion may be configured to detect something other than the residual amount of ink, provided that the detection portion can change the state of light depending on the state of the ink cartridge 30. For example, the first light-blocking plate 67, which can change the state of the light emitted from the light-emitting element of the attachment sensor 113, may serve as the detection portion. In other words, the detection portion may be the first light-blocking plate 67 that can change the state of light depending on whether or not the ink cartridge 30 is in the attached state. Alternatively, the detection portion may be a member (for example, a rib) that can change a state of light emitted from a light-emitting element of a sensor (a type-identification sensor) depending on a type of the ink cartridge 30 (for example, a color of stored ink) attached to the cartridge-attachment section 110.

In the above-described embodiment, the IC board 64 is a flexible substrate having flexibility, but may be a hard plate-shaped rigid board made of glass epoxy, for example.

Further, in the above-described embodiment, the coil spring 78 of the ink supply portion 34 functions to urge the ink cartridge 30 attached to the cartridge-attachment section 110 rearward. However, a different structure from the depicted configuration may be employed for urging the ink cartridge 30 attached to the cartridge-attachment section 110 rearward.

For example, a spring for biasing the ink cartridge 30 rearward may be provided at a position other than the ink supply portion 34. For example, such a spring may be arranged in the recess 96 of the front cover 32. In this case, the spring is brought into pressure contact with the rod 125 of the cartridge-attachment section 110 during insertion of the ink cartridge 30 into the cartridge-attachment section 110, thereby urging the ink cartridge 30 rearward.

In the above-described embodiment, the first light-blocking plate 67 is configured to block the light of the attachment sensor 113. That is, the first light-blocking plate 67 is provided for the purpose of detecting whether or not the ink cartridge 30 is attached to the cartridge-attachment section 110. However, the first light-blocking plate 67 may be provided for a different purpose. For example, the first light-blocking plate 67 may be provided for identifying a type of the ink cartridge 30 (for example, a color of stored ink) attached to the cartridge-attachment section 110.

In the above-described embodiment, the ink chamber 36 is defined by the inner frame 35. However, the ink chamber 36 may be defined by the rear cover 31 and the front cover 32 constituting the outer shell of the ink cartridge 30. That is, the ink cartridge 30 may be configured by the rear cover 31 and the front cover 32, without the inner frame 35 enclosed in the rear cover 31 and front cover 32. Alternatively, an ink bag for storing ink may be accommodated in the rear cover 31 and the front cover 32. In this case, the ink bag may have the same function as the inner frame 35.

Figure 13:
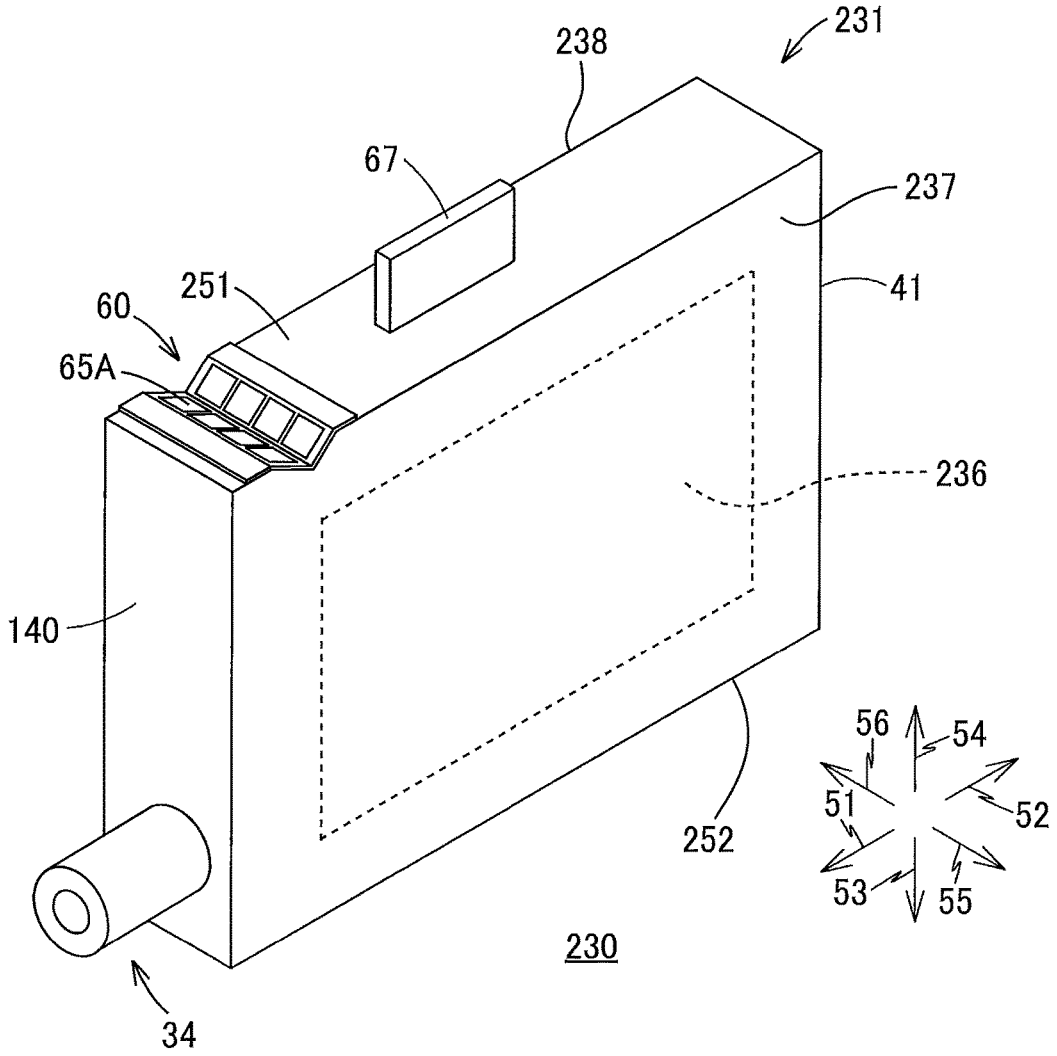
FIG. 13 is a perspective view of an ink cartridge according to a variation of the embodiment.

Still alternatively, the ink chamber 36 may be formed in a housing that does not include the rear cover 31 and front cover 32. FIG. 13 shows an ink cartridge 230 as a variation of the ink cartridge 30 of the embodiment. In this ink cartridge 230, an ink chamber 236 may be defined in a housing 231 of a rectangular parallelepiped shape. The housing 231 includes the front wall 140, the rear wall 41, a top wall 251, a bottom wall 252 and side walls 237 and 238. Each of these walls 140, 41, 251, 252, 237 and 238 constitute an outer shell of the ink cartridge 230. In other words, the ink chamber 236 is defined by the front wall 140, the rear wall 41, the top wall 251, the bottom wall 252 and the side walls 237 and 238. The ink supply portion 34 may be provided at the front wall 140 to protrude frontward therefrom.

Further, in this ink cartridge 230, the electrical interface 60 and the light-blocking plate 67 may be disposed at the housing 231 that defines the ink chamber 236, as shown in FIG. 13. The surfaces of the electrodes 65A of the electrical interface 60 are configured to be engaged with the surfaces 106B of the contacts 106B, as in the above-described embodiment. In this ink cartridge 230, the light-blocking plate 67 is an example of the detection portion and the light-receiving portion. The attachment sensor 113 is an example of the sensor.

Further, while ink serves as an example of the liquid in the above-described embodiment, the liquid of the present disclosure is not limited to ink. For example, a pretreatment liquid that is ejected onto sheets prior to ink during a printing operation may be stored in the liquid cartridge. Alternatively, cleaning water for cleaning the recording head 21 may be stored in the liquid cartridge.

What is claimed is:

1. A liquid cartridge configured to store liquid therein, the liquid cartridge comprising:

a front surface facing frontward;

a rear surface spaced apart from the front surface;

an upper surface disposed between the front surface and the rear surface, the upper surface facing upward;

a liquid supply portion provided at the front surface and configured to supply the liquid to outside of the liquid cartridge;

a detection portion including a light-receiving portion configured to receive incident light thereon, the light-receiving portion being positioned upward relative to the upper surface, the detection portion being configured to change a state of the incident light depending on a state of the liquid cartridge;

an electrical interface disposed at the upper surface, the electrical interface being positioned frontward relative to the light-receiving portion; and an engaging surface facing rearward and configured to be engaged with an external member such that the engagement between the engaging surface and the external member restricts the liquid cartridge from moving rearward, the engaging surface being positioned frontward relative to the light-receiving portion.

2. The liquid cartridge according to claim 1, wherein the engaging surface is positioned downward relative to the light-receiving portion.

3. The liquid cartridge according to claim 1, wherein the electrical interface has a recessed portion recessed downward, and wherein the engaging surface is at least a part of the recessed portion.

4. The liquid cartridge according to claim 3, wherein the electrical interface is formed in a sheet shape, the electrical interface including a first portion and a second portion whose thickness is smaller than a thickness of the first portion, the electrical interface being arranged such that the second portion is disposed rearward of the first portion, and wherein the first portion includes the engaging surface.

5. The liquid cartridge according to claim 3, wherein the engaging surface is sloped relative to a horizontal direction such that an angle defined between the engaging surface and the horizontal direction is smaller than or equal to 30 degrees.

6. The liquid cartridge according to claim 3, wherein the electrical interface includes:

a circuit board having flexibility; and an electrode provided on the circuit board.

7. The liquid cartridge according to claim 1, wherein the liquid supply portion includes an urging member configured to urge the liquid cartridge rearward.

8. The liquid cartridge according to claim 7, the liquid cartridge having a depth in the horizontal direction, a height in a vertical direction orthogonal to the horizontal direction, and a width in a widthwise direction orthogonal to the horizontal direction and the vertical direction, wherein the liquid supply portion further includes a liquid outlet, wherein the urging member includes a valve movable in the horizontal direction to open and close the liquid outlet, wherein the external member includes an external engaged surface that faces downward and frontward, wherein the engaging surface faces upward and rearward, and wherein the liquid cartridge is pivotally movable between a first posture and a second posture, the engaging surface being disposed frontward relative to the external engaged surface and being in contact with the external engaged surface in the first posture of the liquid cartridge, the engaging surface being located downward relative to the external engaged surface and being out of contact with the external engaged surface in the second posture of the liquid cartridge.

9. The liquid cartridge according to claim 1, wherein the detection portion is configured to change the state of the incident light depending on an amount of the liquid stored in the liquid cartridge.

10. The liquid cartridge according to claim 9, wherein the light-receiving portion is movable between a detection position and a non-detection position different from the detection position in accordance with the amount of the liquid, the light-receiving portion at the detection position being configured to block or attenuate the received light.

11. The liquid cartridge according to claim 10, further comprising a light-blocking plate extending from the upper surface, the light-blocking plate being disposed between the light-receiving portion and the engaging surface in the horizontal direction, the light-blocking plate being configured to block or attenuate incident light.

12. The liquid cartridge according to claim 1, further comprising a positioning surface configured to be in contact with the external member, the positioning surface facing downward and being arranged to overlap with the engaging surface when the liquid cartridge is viewed from above.

13. A liquid-consuming device comprising:

a liquid cartridge configured to store liquid therein and comprising:

a front surface facing frontward;

a rear surface spaced apart from the front surface;

an upper surface disposed between the front surface and the rear surface, the upper surface facing upward;

a liquid supply portion provided at the front surface and configured to supply the liquid to outside of the liquid cartridge;

a detection portion including a light-receiving portion configured to receive incident light thereon, the light-receiving portion being positioned upward relative to the upper surface, the detection portion being configured to change a state of the incident light depending on a state of the liquid cartridge;

an electrical interface disposed at the upper surface at a position frontward relative to the light-receiving portion, the electrical interface including an electrode; and an engaging surface facing rearward, the engaging surface being disposed frontward relative to the light-receiving portion;

a cartridge-attachment section, the liquid cartridge being movable in a frontward direction so as to be attached to the cartridge-attachment section and movable in a rearward direction so as to be detached from the cartridge-attachment section, the liquid cartridge attached to the cartridge-attachment section being in an attached state, the cartridge-attachment section comprising:

a contact configured to be electrically connected to the electrode of the electrical interface of the liquid cartridge attached to the cartridge-attachment section;

a sensor including a light-emitting element and a light-receiving element positioned opposite to each other, the light-receiving portion of the liquid cartridge attached to the cartridge-attachment section being configured to be interposed between the light-emitting element and the light-receiving element; and an engaged surface configured to be engaged with the engaging surface of the liquid cartridge attached to the cartridge-attachment section such that the engagement between the engaging surface of the liquid cartridge and the engaged surface restricts the liquid cartridge attached to the cartridge-attachment section from moving rearward; and a consuming section configured to consume the liquid stored in the liquid cartridge attached to the cartridge-attachment section.

14. The liquid-consuming device according to claim 13, wherein the cartridge-attachment section defines an internal space configured to accommodate the liquid cartridge therein, the cartridge-attachment section having an upper portion, and wherein the contact is provided at the upper portion of the cartridge-attachment section and faces the internal space of the cartridge-attachment section, the contact including the engaged surface.

15. The liquid-consuming device according to claim 13, wherein the liquid cartridge in the attached state has a depth in a horizontal direction, a height in a vertical direction orthogonal to the horizontal direction, and a width in a widthwise direction orthogonal to the horizontal direction and the vertical direction, wherein the liquid supply portion includes a liquid outlet and valve movable in the horizontal direction to open and close the liquid outlet, the valve serving as an urging member configured to urge the liquid cartridge in the attached state rearward, wherein the engaged surface faces downward and frontward, wherein the engaging surface faces upward and rearward, wherein the cartridge-attachment section further comprises a tube configured to be inserted into the liquid supply portion of the liquid cartridge attached to the cartridge-attachment section to open the liquid outlet, and wherein the liquid cartridge in the attached state is pivotally movable about the tube connected to the liquid supply portion between a first posture and a second posture, the engaging surface being disposed frontward relative to the engaged surface and being in contact with the engaged surface in the first posture of the liquid cartridge, the engaging surface being located downward relative to the engaged surface and being out of contact with the engaged surface in the second posture of the liquid cartridge.

16. The liquid cartridge according to claim 1, wherein the engaging surface is at least a part of the electrical interface.

17. The liquid-consuming device according to claim 13, wherein the engaging surface is at least a part of the electrical interface.

* * * * *